United States Patent [19]

Bledsoe et al.

[11] Patent Number: 4,834,073

[45] Date of Patent: May 30, 1989

[54] PASSIVE MOTION EXERCISER

[75] Inventors: Gary R. Bledsoe, Grand Prairie; Gregory A. Bledsoe, Arlington; Eric N. Bledsoe, Arlington; Barry P. Bledsoe, Arlington; Clifford H. Carlson, Roanoke; Clarence E. Bledsoe, Arlington; Brett O. Bledsoe, Arlington; Blake H. Bledsoe, Arlington; John C. Cade, Arlington, all of Tex.

[73] Assignee: Medical Technology, Inc., Grand Prairie, Tex.

[21] Appl. No.: 17,250

[22] Filed: Feb. 20, 1987

[51] Int. Cl.[4] ..... A61H 1/02

[52] U.S. Cl. ..... 128/25 B; 128/25 R

[58] Field of Search ..... 128/25 R, 25 B, 26, 128/80 G, 80 R, 80 F, 69, 70, 71, 74, 48, 49, 51, 52, 84 R

[56] References Cited

U.S. PATENT DOCUMENTS

| | | | |
|---|---|---|---|
| 198,723 | 12/1877 | Woods | 128/84 R |
| 2,024,325 | 12/1935 | Allen | 128/84 R |
| 2,384,779 | 9/1945 | Williams | 128/84 R |
| 4,462,252 | 7/1984 | Smidt et al. | 73/379 |
| 4,549,534 | 10/1985 | Zagorski et al. | 128/25 R |
| 4,566,440 | 1/1986 | Berner et al. | 128/25 R |

OTHER PUBLICATIONS

Empi Model CM-100 System/Empi., Inc./1986/one page.

Orthomotion/Professor Dr. W. Kusswetter/3 pages.

Danniflex 400SL CPM System/Danninger Medical Technology, Inc., 1986/2 pages.

Sutter CPM 2000 S/SutterBiomedical, Inc./1984/5 pages.

Invacare Knee cpm/Invacare Corporation/1986/4 pages.

Sutter CPM 9000/SutterBiomedical Inc./1985/6 pages.

New Auto Flex II/Chattanooga Corporation/1986/4 pages.

*Primary Examiner*—Richard J. Apley.

*Assistant Examiner*—Howard Flaxman

*Attorney, Agent, or Firm*—Hubbard, Thurman, Turner & Tucker

[57] ABSTRACT

A passive motion exerciser for simultaneously flexing the hip and knee joints of a human leg has a base portion with an inclined guide member positionable parallel to a line extending through the ankle and hip joints of the leg, a reversible motor-driven drive member movable upwardly and downwardly along the inclined guide member, and an elongated leg support frame structure securable to the leg and longitudinally adjustable to fit legs of varying lengths. The support frame structure has a first end portion positionable adjacent the ankle joint, a second end portion positionable between the knee and hip joint, and a pivoted intermediate portion positionable adjacent the knee joint. A connecting member is attached to the guide member for movement therealong parallel to the drive member and is connected to the first outer end portion of the support frame structure. The second outer end portion of the support frame structure is pivotally interconnected to the drive member by a cam-driven linkage structure. In response to movement of the drive member, the linkage structure translationally and pivotally drives the second end portion of the support frame structure in a manner causing simultaneous flexure of the hip and knee joints and automatically maintaining a predetermined correlation between the flexure angles of the hip and knee joints regardless of the length of the supported leg.

43 Claims, 7 Drawing Sheets

PASSIVE MOTION EXERCISER

BACKGROUND OF THE INVENTION

The present invention relates generally to mechanical devices used to cyclically flex and unflex the hip and knee joints of a human leg for rehabilitative purposes, and more particularly provides a passive motion exerciser which uniquely functions to simultaneously flex the hip and knee joints in a manner maintaining a predetermined correlation between the hip and knee joint flexure angles regardless of the length of the leg.

Passive motion leg exercising devices are well known in the medical arts and are typically utilized subsequent to leg joint surgery to slowly flex and unflex the hip and knee joints of a human leg without exertion or effort by the patient. A variety of rehabilitative benefits are derived through use of passive motion exercisers of this type. For example, such passive exercising of a hip or knee joint functions to break up scar tissue around the joint, without muscle contractions, to prevent "freeze-up" of the joint. Additionally, the use of a passive motion exercising device forces fluid motion in the joint to thereby increase blood circulation in the tissue surrounding it. Moreover, such passive exercise of the joint considerably reduces the pain level during the healing process. Because of this reduction in pain level, the necessity for pain reducing drugs is concomitantly reduced. Finally, the use of a mechanical device such as the passive motion exerciser reduces the physical therapy cost involved which arise when a physical therapist is used to manually manipulate the leg.

Conventional passive motion exercisers are typically provided with a leg suppot assembly to which a portion of the leg to be passively exercised is securable. This leg support assembly, in turn, is interconnected to a base portion of the exerciser by a suitable linkage structure. A motor within the base portion is used to drive the leg support assembly about a primary pivot point on the linkage structure to achieve the desired cyclical flexing and unflexing of the hip and knee joints.

Such conventional passive motion exercisers may generally be divided into two broad categories—those in which the primary linkage structure pivot point is alignable with the hip joint, and those in which such primary pivot point is designed to be positioned in a non-aligned, spaced relationship with the hip joint. Despite their well known rehabilitative benefits, however, each of these types of conventional passive motion exerciser is subject to a variety of equally well known disadvantages and limitations.

For example, the linkage structure on exercisers in which the primary pivot point is alignable with the hip joint typically extends along one side of the exerciser base portion and terminates at a point closely adjacent the hip joint of the leg being exercised, the other leg extending along the opposite side of the exerciser. Accordingly, to exercise the other leg, it is necessary to disassemble the linkage structure and remove it from the exerciser, and then reconnect the linkage structure to the other side of the exercising apparatus. As is well known, this can be a somewhat cumbersome, inconvenient and time-consuming procedure.

This particular problem is alleviated by exercisers in which the primary pivot point of the linkage structure is not aligned with the hip joint, but is forwardly offset therefrom. In this type of passive motion exerciser, the changeover from leg to leg is more conveniently and quickly effected. However, because the hip pivot point of the apparatus is not aligned with the exercised leg hip joint, the apparatus itself is not anatomically aligned with the leg being exercised. Because of this misalignment, the apparatus has a tendency to shift relative to the patient during its operation. Additionally, during its cyclical flexing motion, the leg support structure tends to move relative to the leg which it supports. This relative movement can cause uncomfortable abrasion of the exercised leg by the leg support structure, particularly where the exerciser is utilized for extended periods of time.

Another limitation inherent in conventional passive motion exercisers of both types is that the leg support assembly has a fixed width and depth sized to accommodate an "average" leg. This limitation can lead to patient discomfort in cases where the supported leg is appreciably thinner or thicker than average.

In addition to the foregoing limitations and disadvantages, conventional passive motion exercisers typically have a significant shortcoming relating to the heretofore unavoidable variance in the relationship between the hip and knee joint flexure angles of the supported leg when legs of different lengths are passively exercised. More specifically, in conventional exercisers leg length variances change the knee joint flexure angle resulting from a given angle of hip joint flexure so that proper "calibration" between the total exerciser stroke length and the resulting angular range of knee joint flexure is rather difficult to achieve.

It is, of course, often critical to the rehabilitative process following knee surgery that the knee joint flexure range be maintained within medically prescribed limits. To overcome the aforementioned calibration shortcoming, conventional exercisers are typically provided with a potentiometer device which actually measures the flexure angle of the knee joint. The stroke length of the exerciser must be carefully correlated, on a trial and error basis, with the potentiometer reading to achieve the desired flexure angle range for the knee joint. In other words, the conventional exerciser must be carefully "tuned" to each leg which it flexes. If this sometimes laborious calibration procedure is not carefully and skillfully executed, damage to the knee joint can easily occur.

It can be seen from the foregoing that conventional passive motion exercisers are subject to a variety of limitations and disadvantages. It is accordingly an object of the present invention to provide passive motion exercising apparatus which eliminates or substantially minimizes abovementioned and other limitations and disadvantages commonly associated with conventional mechanial leg exercisers.

SUMMARY OF THE INVENTION

In carrying out principles of the present invention, in accordance with a preferred embodiment thereof, an improved passive motion exerciser is provided for use in cyclically and simultaneously flexing the hip and knee joints of a human leg to rehabilitate it subsequent to hip or knee joint surgery. The exerciser is uniquely constructed and operative to maintain a predetermined correlation between the hip and knee joint flexure angles which is essentially independent of the length of the leg being passively flexed. Accordingly, the conventional necessity of using a trial and error adjustment technique to properly match the exerciser stroke length with the resulting knee flexure angle for each exercised leg is eliminated.

In a preferred embodiment thereof, the exerciser of the present invention comprises a base portion which is supportable on the upper surface of, for example, a hospital bed mattress upon which the patient is lying on his or her back. The base portion is provided with a horizontally inclined guide member which is positionable parallel to a line extending through the hip and ankle joints of the exercised leg when it is operatively secured to the exerciser. A drive member connected to the underside of the guide member is cyclically driven upwardly and downwardly along the guide member by a reversible motor operatively connected to a lead screw threadingly received by the guide member.

To support the exercised leg an articulated, elongated leg support frame structure is provided which comprises pivotally connected, telescoped thigh and calf support tube pairs positionable on opposite sides of the exercised leg and interconnected by depth-adjustable thigh and calf support cradle members. The length of each of the tube pairs may be selectively adjusted by set screw members which are operative to lock each of the tube member pairs in a telescopically adjusted position. The outer ends of the calf support tube pairs are pivotally secured to a connecting member which is positioned above and supported on the guide member for upwardly and downwardly inclined movement along its length.

The drive member is interconnected with the outer ends of the thigh support tube pairs by linking means which are translationally driven by the drive member and are simultaneously pivoted by cam means carried by the base portion of the exerciser. The simultaneous translation and pivoting of the linking means, which have side portions positionable on opposite sides of the exercised leg, translationally and pivotally drives the thigh tube portion of the leg support frame structure in a manner causing cyclical flexing and unflexing of the hip and knee joints of the leg being exercised. The resulting translational and pivotal motion of the support frame structure causes the ankle joint to move relative to the guide member along a line extending transversely through a line passing transversely through the hip joint of the exercised leg. The linking means also function to translate the outer ends of the thigh support tube pairs in a circular arc centered about the line extending transversely through the hip joint, and pivots the thigh support tube pairs in a manner such that their outer ends are always pointed at the transverse hip line.

The result of this unique motion and geometrical positioning imparted to the leg support frame structure by the linking means maintains precise anatomical alignment between the support structure and the exercised leg, and maintains the aforementioned correlation between the knee and hip flexure angles regardless of the length of the leg being exercised.

Gimballed portions of the leg support frame structure and the linking means permit the opposite side portions of each of these structures to be laterally adjusted relative to one another to accommodate width variations in the supported leg. Means are provided for releasably locking these opposite side portions in their laterally adjusted positions. Coupled with the leg depth adjustment provided by the adjustable cradle members, this width adjustment significantly enhances the exercised leg comfort of the patient.

The exerciser of the present invention may be easily and quickly calibrated to provide precise control of the hip and/or knee joint flexural angle range simply by positioning two adjustment levers disposed on a limit control panel to select the minimum and maximum hip joint flexure angle (and the directly correlated minimum and maximum knee flexure angle). Each of the levers has supported thereon an optical beam limit switch and a backup mechanical limit switch. A tab member carried by the movable linking means is moved back and forth between the spaced optical switches. When the tab member is aligned with one of the optical switches it interrupts its light beam to cause reversal of the motor and concomitant movement of the tab toward the other optical switch, and reversal of the travel direction of the drive member relative to the guide member. In the event that one or both of the optical switches fail, the backup mechanical switches function to effect motor reversal.

According to another feature of the present invention the degree of ankle joint flexure during leg flexure may be selectively controlled. To achieve this control, a foot support bracket is pivotally connected to the outer ends of the calf support tube pairs so that it is pivotable relative to both the leg support frame structure and the connecting member. Means are provided for adjustably locking the foot support bracket to either the calf support tube pairs or the connecting member. With the foot support bracket locked to the calf support tube pairs the ankle joint does not flex during leg flexure. However, with the foot support bracket locked to the connecting member a controlled amount of ankle joint flexure is achieved during leg flexure.

According to another aspect of the present invention the base portion of the exerciser is provided, along its bottom surface, with a downturned end edge portion which faces the patient's hips during exerciser operation. This edge portion tends to dig into the mattress and impedes shifting of the base portion toward or away from the patient's hips. It also facilitates a forward and downward pivoting of the base portion to maintain the exerciser in precise alignment with the exercised leg as the patient's body pivots when the center of gravity of the cyclically flexed leg is shifted and the leg sinks lower into the mattress.

To summarize, the passive motion exerciser of the present invention provides a variety of structural and operational advantages over conventional mechanical leg exercisers. Because of its unique maintenance of the hip joint-knee joint flexure angle correlation for legs of varying lengths it is considerably easier to calibrate, and the calibration process may be performed in a much quicker manner with far less chance of operator error and resulting leg joint damage. The leg width and depth adjustment features, together with the unique pivoting base portion design, provide for enhanced patient leg comfort and improved maintenance of precise alignment between the exerciser and the leg which it passively flexes.

It should further be noted that the exerciser of the present invention solves yet another problem commonly associated with many types of conventional mechanical leg exercisers—namely the difficulty encountered in switching the conventional exerciser from a right leg to a left leg, or vice versa. All that is required in the present invention to effect such leg-to-leg changeover is to move the exerciser from one leg over to the other leg and operatively connect the second leg to the leg support frame structure. Because of the unique positioning and operation of the linkage structure of the passive motion exerciser, no disassembly and reassembly of such structure is required to effect leg-to-leg change over.

DETAILED DESCRIPTION

Figure 1:
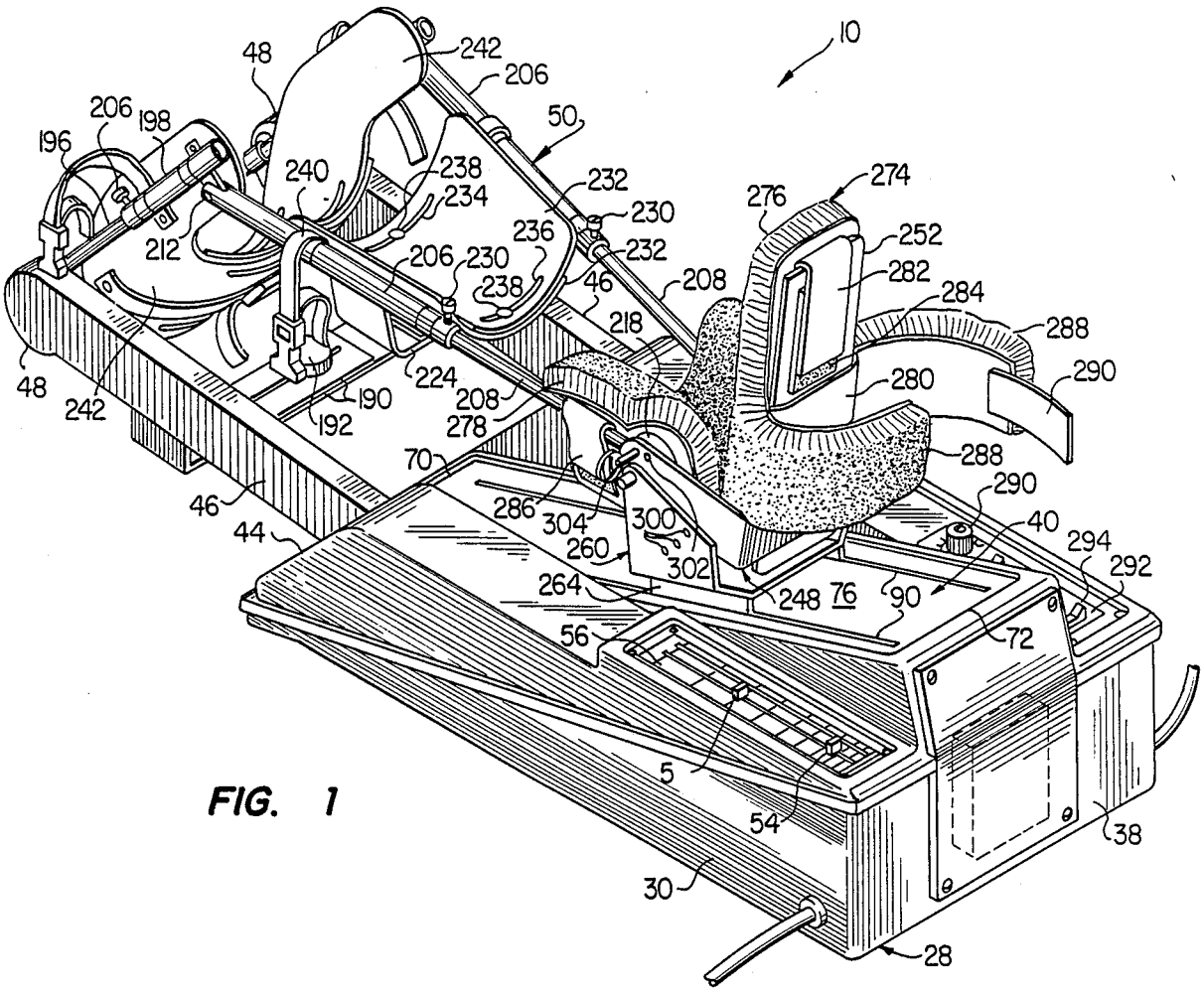
FIG. 1 is a perspective view of a passive motion leg exerciser embodying principles of the present invention, with certain leg padding portions being removed for illustrative clarity.
Figure 2:
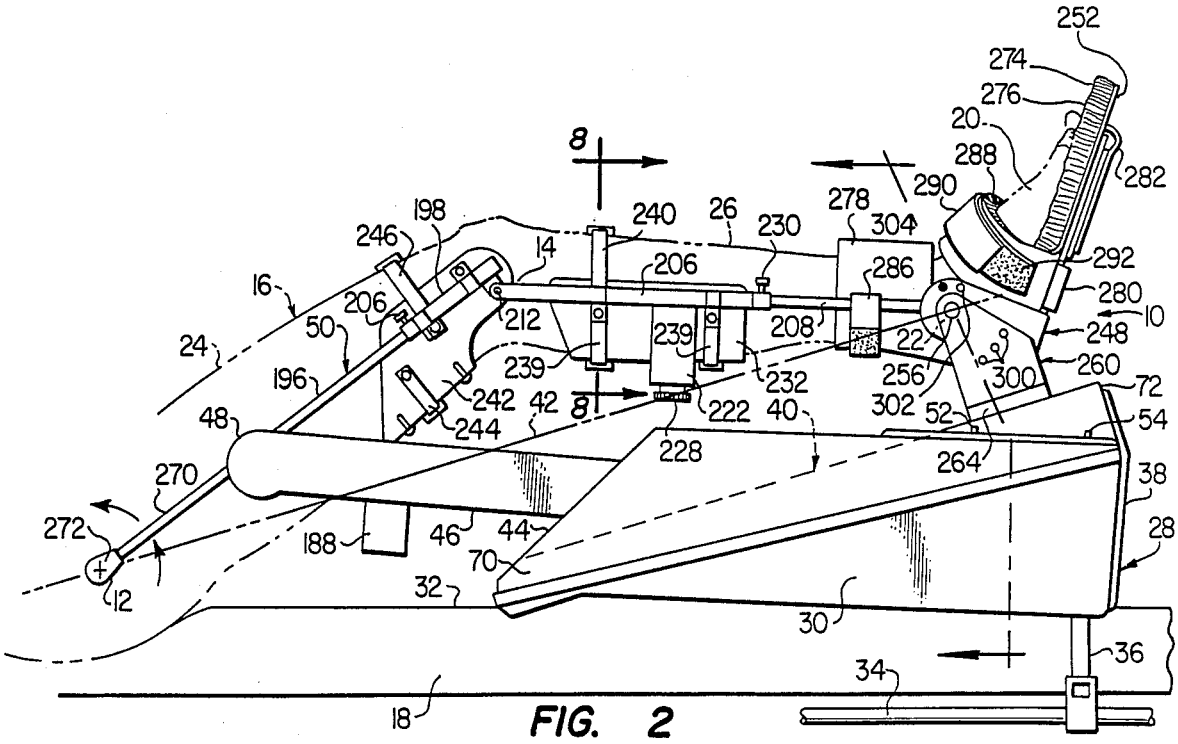
FIGS. 2 and 3 are reduced scale side elevational views of the exerciser operatively supported on the upper surface of a hospital bed mattress, and illustrate the exerciser being used to cyclically flex and unflex the hip and knee joints of a patient's leg operatively secured thereto.
Figure 3:
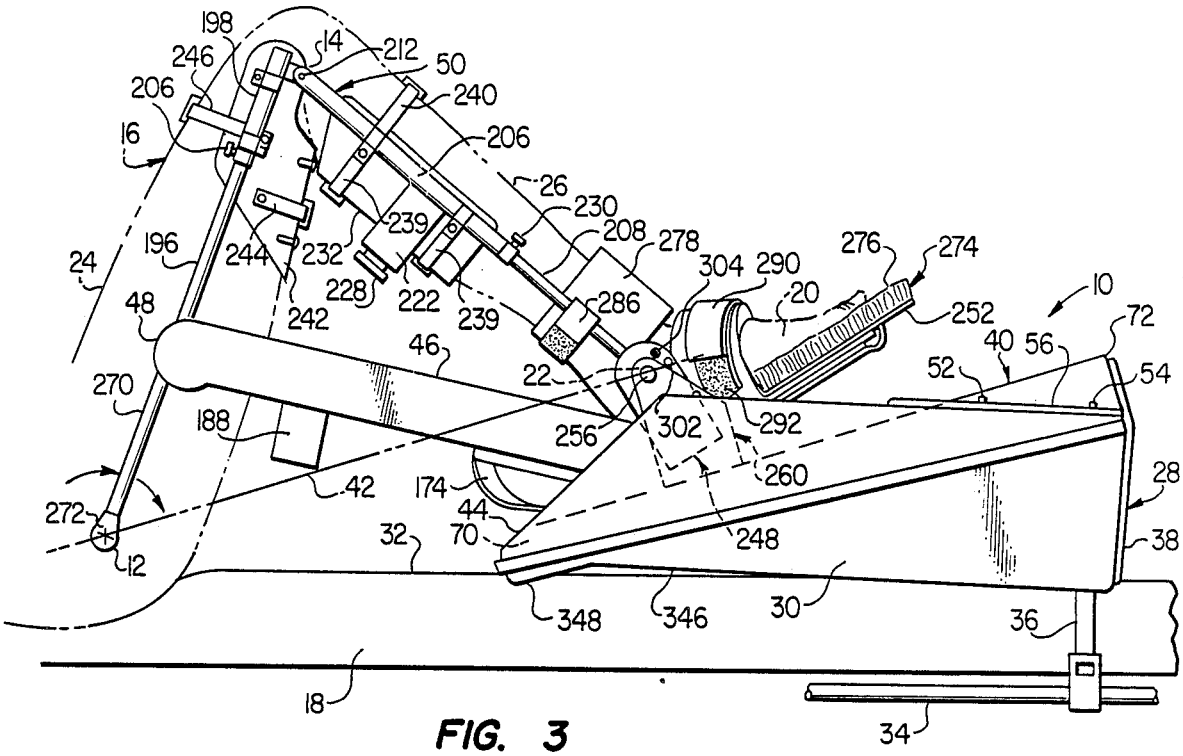

Illustrated in FIGS. 1–3 is a passive motion exerciser 10 which embodies principles of the present invention and is utilized to passively flex and unflex the hip and knee joints 12, 14 of the right leg 16 of a patient lying on his or her back on a suitable support surface such as a hospital mattress 18. The leg 16 has a foot 20, an ankle joint 22, an upper leg portion 24 extending between the hip and knee joints 12 and 14, and a lower leg portion 26 extending between the knee and ankle joints 14 and 22. As will be seen, exerciser 10 is adapted to passively and cyclically flex and unflex the leg 16 (or the patient's other leg) between the representative leg positions indicated in FIGS. 2 and 3 without any exertion or effort on the part of the patient. This passive flexure of the leg is beneficial in the rehabilitative process following surgery on the hip joint 12 or the knee joint 14.

The exerciser 10 includes a base portion 28 having a base housing 30 which is adapted to rest upon the upper surface 32 of mattress 18 and is securable to adjacent bed frame members 34 by means of bed strap members 36 secured to the housing 30 adjacent its forward end 38. Base portion 28 is provided with an inclined guide or track member 40 which slopes downwardly and forwardly from adjacent the front end 38 of housing 30 and is positionable on the mattress 18 so that it extends essentially parallel to a line 42 extending through the patient's hip joint 12 and ankle joint 22 when the leg 16 is operatively supported in the exerciser 10 as subsequently described.

Extending rearwardly through openings 43 (FIG. 5) in the back end 44 of the housing 30, and positionable on opposite sides of the leg 16, are a pair of elongated linkage structure shrouds 46 which house various linking arm members subsequently described. Interconnected between these linking arms, adjacent the outer ends 48 of the linkage shrouds 46, and the guide member 40 is an articulated, elongated leg support frame structure 50 to which the passively exercised leg 16 is operatively securable. As will be seen, the exerciser 10 is motor-driven, via the linkage structure extending through the linkage shrouds 46, to translationally and pivotally drive the leg frame support structure 50 in a manner causing the cyclical flexing and unflexing of the exercised leg 16 as illustrated in FIGS. 2 and 3.

Before describing in detail the structure and operation of the exerciser 10, it should be noted that the exerciser of the present invention provides a unique and extremely beneficial advantage over passive motion leg exercisers of conventional construction. Specifically, it is well known that following knee surgery it is often crucial that the rehabilitative flexure of the knee joint be kept within medically prescribed angular limits. As in the case of the exerciser 10 of the present invention, conventional motorized leg exercisers typically pivotally drive the upper leg portion to cause angular flexure of the hip joint and concomitant angular flexure of the knee joint. The degree of such angular hip joint flexure is regulated by adjusting the reversible stroke length of the exerciser's main drive system. For a given length leg being exercised, there is a correlation between the flexure angle of the hip joint and the resulting flexure angle of the knee joint.

However, when a leg of a greater or shorter length is operatively connected to the conventional exerciser, this correlation changes. Stated otherwise, in conventional motorized leg exercisers, when the hip joints of legs of differing lengths are pivoted through the same angle, the knee joints on such legs are pivotally flexed through different angles. The result of this lack of uniform correlation between the hip and knee flexure angles for legs of varying lengths manipulated by conventional exercisers is that the actual knee flexure angle for each exercised leg must be actually measured (usually with a potentiometer device operatively associated with the knee area of the exercised leg) and, by trial and error, be laboriously calibrated to the hip joint flexural range actually being produced by the exerciser. If this trial and error calibration process is not carefully and skillfully performed by the operator of the machine, knee joint damage can easily result.

The exerciser 10 of the present invention essentially eliminates this calibration problem by uniquely maintaining a predetermined correlation between the flexure angle of the hip joint and the flexure angle of the knee joint, such correlation being essentially independent of the overall length of the normal human leg being passively exercised. As will be seen, all that is necessary in the exerciser 10 to quickly and precisely achieve the prescribed knee joint angular flexure range for a leg of any length operatively connected to the exerciser is to selectively position two control levers 52 and 54 on a limit control panel portion 56 of the exerciser, and turn the exerciser on. For given positions of these two levers 52, 54 the knee joint flexural angular range will be essentially identical regardless of the length of the leg operatively supported in and aligned with the leg support frame structure 50.

Figure 4:
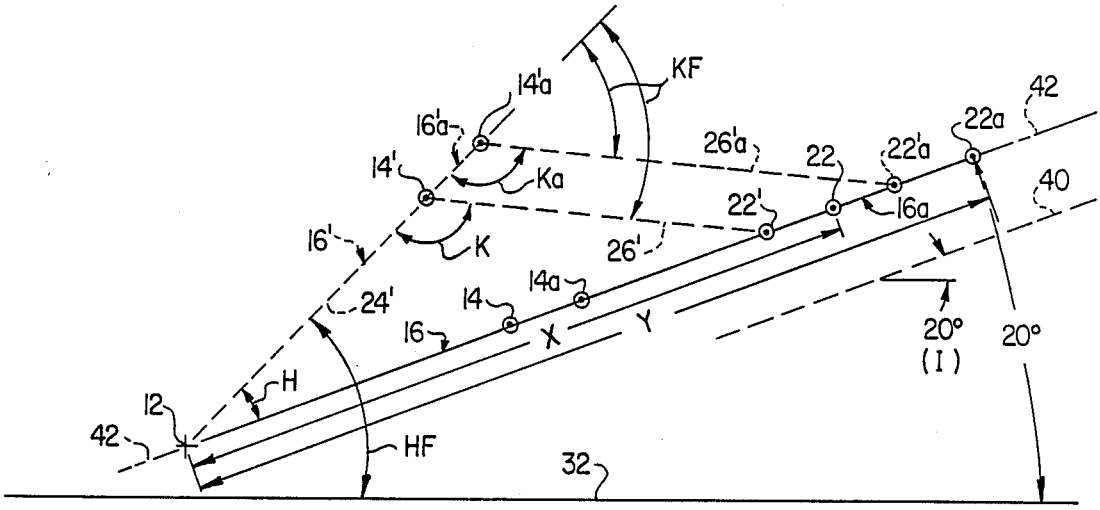
FIG. 4 is a schematic line diagram illustrating the unique manner in which the exerciser maintains a predetermined correlation between the hip joint flexure angle H and the knee joint flexure angle K of the patient's leg regardless of the length thereof.

This novel and advantageous result structurally incorporated into the exerciser 10, and the underlying geometrical basis therefor, is schematically depicted in FIG. 4 which illustrates the representative right leg 16 being flexed by the exerciser 10 from a fully extended, solid line position to a dotted line flexed position denoted by the reference numeral 16'. The fully extended leg 16 has an overall length X measured between the hip joint 12 and the ankle joint 22 and, as previously indicated, has a knee joint 14, an upper leg portion 24 (FIGS. 2 and 3) extending between the hip and knee joint, and a lower leg portion 26 (FIGS. 2 and 3) extending between the knee and ankle joints.

In its fully extended position, the leg 16 extends parallel to the inclined guide member 40 which has a horizontal inclination angle of 20° relative to the horizontal upper surface 32 of the mattress 18. Operation of the exerciser 10 cyclically flexes the leg 16 between its solid line position depicted in FIG. 4 and the dotted line position, indicated by the reference numeral 16', in which the knee joint 14 is moved to the position 14', the ankle joint 22 is moved to the position 22', the upper leg portion 24 is pivoted to the position 24', and the lower leg portion 26 is pivoted to the position 26'.

As will be seen, as the exerciser 10 cyclically flexes the leg 16, it causes the ankle joint 22 to move along the line 42 which extends through the hip and ankle joints 12 and 22 and is parallel to the guide member 40. Accordingly, the line 42 is inclined at an angle of 20° relative to the horizontal surface 32. Line 42 also extends transversely through a reference line which passes transversely through the hip joint 12. Flexure of the leg 16 from the solid line position to the dotted line position 16' in FIG. 4 pivots the hip joint 12 through an angle H, and pivots the knee joint 14 through a knee flexion angle KF which is equal to 180°−K, with K being the resulting angle between the upper and lower leg portions.

For purposes of leg flexure comparison, a second leg $\mathbf{16}_a$ is also depicted in FIG. 4 and is superimposed upon the leg 16. The comparison leg $\mathbf{16}_a$ has a hip joint which is aligned with the hip joint 12 of leg 16, a knee joint $\mathbf{14}_a$, and an ankle joint $\mathbf{22}_a$. Leg $\mathbf{16}_a$ has a somewhat longer length Y extending between its hip joint and its ankle joint $\mathbf{22}_a$, and is flexed by the exerciser 10 from the solid line $\mathbf{16}_a$ (in which the leg $\mathbf{16}_a$ is fully extended and positioned along the line 42) to the dotted line position $\mathbf{16}_a'$. As in the case of the leg 16, the hip joint of the leg $\mathbf{16}_a$ is driven by the exerciser 10 through a hip joint flexure angle H and its ankle joint $\mathbf{22}_a$ is moved in opposite directions along the line 42. In the dotted line flexed position $\mathbf{16}_a'$ of leg $\mathbf{16}_a$, the knee joint $\mathbf{14}_a$ is moved to the position $\mathbf{14}_a'$, and the ankle joint $\mathbf{22}_a$ is moved through the position $\mathbf{22}_a'$. Additionally, the lower leg portion of the leg $\mathbf{16}_a$ is moved through the dotted line position $\mathbf{26}_a'$ which is parallel to the dotted line position 26' of the lower leg portion of the leg 16 in its flexed position. The flexure of leg $\mathbf{16}_a$ to its dotted line position $\mathbf{16}_a'$ also causes flexure of its knee joint $\mathbf{14}_a$ through a knee flexion angle KF which is equal to $180° - K_a$.

Importantly, the knee flexure angle KF of the longer leg $\mathbf{16}_a$ is identical to the knee flexure angle KF of the shorter leg 16. These identical knee flexure angles for legs of varying lengths are achieved without variance in the hip flexure angle H relative to the line 42. Accordingly, in the exerciser 10 a correlation is maintained between the hip flexure angle of the leg being passively exercised and the resulting knee flexure angle, such correlation being substantially independent of the length of the leg being exercised. In the exerciser 10 of the present invention, this uniform correlation is expressed by the equation $KF=2\ (HF-I)$ wherein KF is the total knee flexure angle, HF is the total hip flexure angle, H is the hip flexure angle, and I is the angle of horizontal inclination of the line 42 along which the ankle joint is moved. In the illustrated preferred embodiment of the exerciser 10 the horizontal inclination angle I is 20°.

It is well known that in the normal human leg, the distance between the hip joint and the knee joint is substantially equal to the distance between the knee joint and the ankle joint. Because of this length relationship between the upper leg portion and the lower leg portion in the normal human leg, it can be seen in FIG. 4 that the flexed legs 16 and $\mathbf{16}_a$ form with the ankle joint motion line 42 isoceles triangles. Specifically, for the flexed leg 16, the dotted line portions 12–14' and 14'–22' form with the portion 12–22' of the line 42 an isoceles triangle, while the dotted line portions $\mathbf{12–14}_a'$ and $\mathbf{14}_a'–\mathbf{22}_a'$ of the flexed leg $\mathbf{16}_a$ form with the portion $\mathbf{12–22}_a'$ of line 42 a similar isoceles triangle. By flexing the exercised leg in a manner maintaining the motion of the ankle joint along the line 42 to concomitantly maintain the leg geometry just described, the exerciser 10 may be rapidly calibrated to achieve a predetermined range of knee joint flexure simply by selecting a range of hip joint flexure. There is simply no need to actually measure the knee joint flexure or use a trial and error method to achieve a desired range of knee joint flexure.

The structure and operation of the exerciser 10 which achieves this unique and very beneficial result will now be described in detail with reference to FIGS. 5–7. Carried within the housing 30 of base portion 28 are a pair of elongated base support frame members 58, 60 which are intersecured in a parallel, spaced apart relationship by a pair of crossbracing members 62 and 64 positioned adjacent the back ends 66 of members 58, 60, and a similar crossbrace member (not illustrated) positioned adjacent the front ends 68 of such base frame members. The inclined guide member 40 is positioned between the base frame members 58, 60 and is bolted adjacent its lower back end 70 (FIG. 7) to the crossbrace member 62. The upper front end 72 of the guide member 40 (FIGS. 1–3) is intersecured to the base frame members 58, 60 adjacent their front ends 68 by means of a generally U-shaped, sloped front support frame member 74 (FIG. 6).

Figure 5:
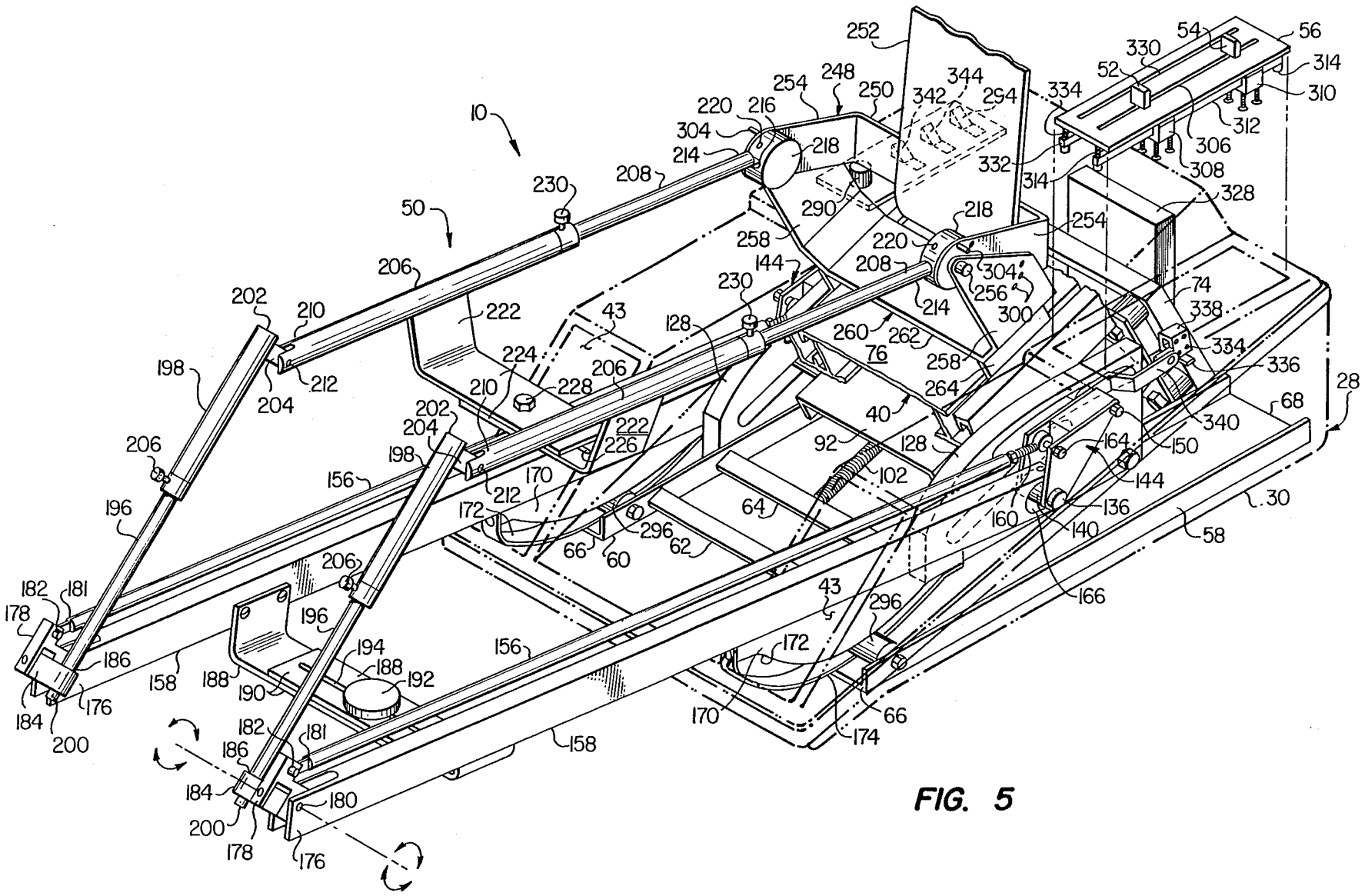
FIG. 5 is a partially fragmented and exploded enlarged scale perspective view of the exerciser, with the linkage structure shrouds being removed and the base housing being shown in phantom for illustrative clarity.
Figure 6:
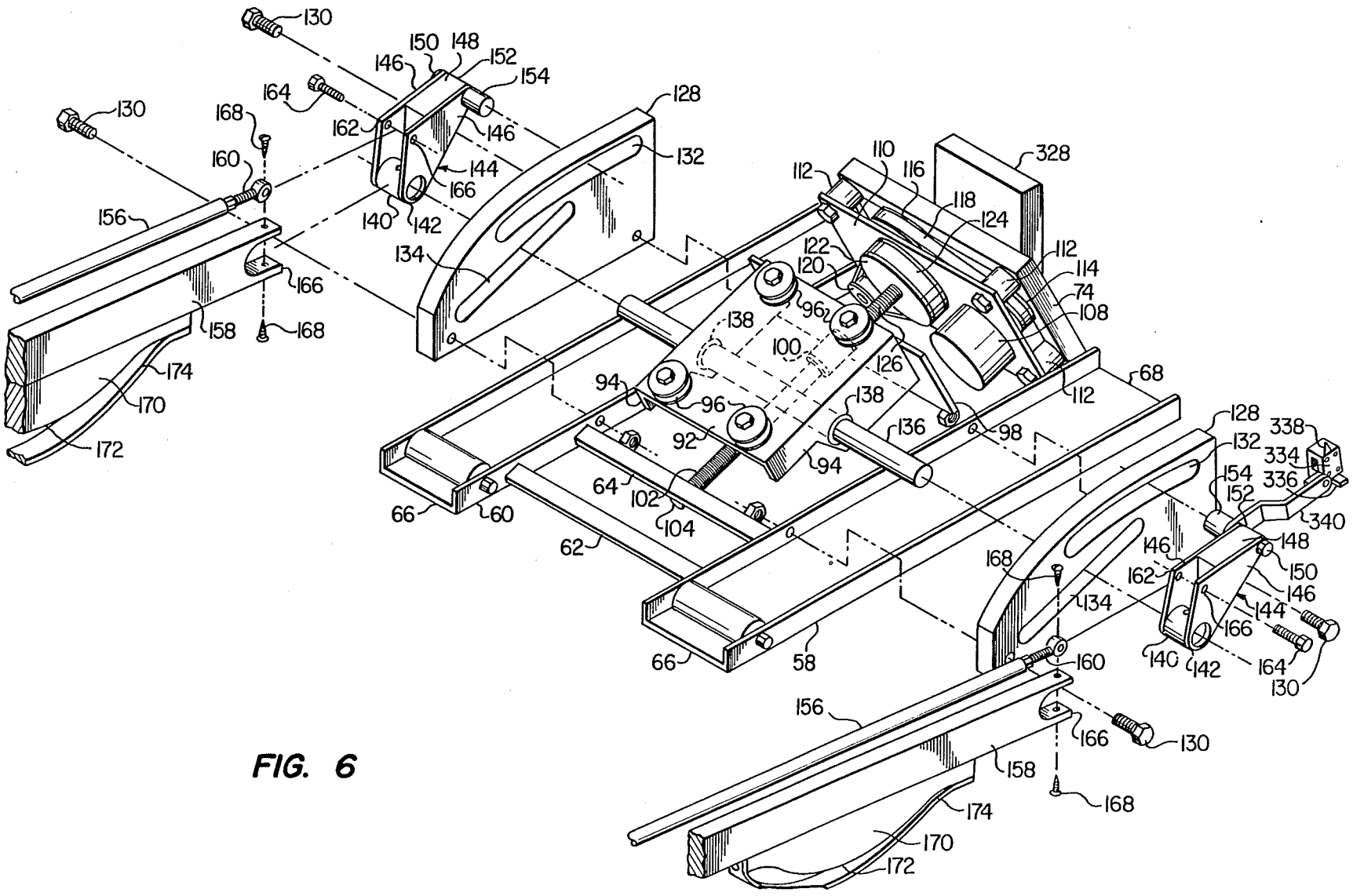
FIG. 6 is a partially fragmented exploded perspective view of the drive system and certain adjacent components of the exerciser.
Figure 7:
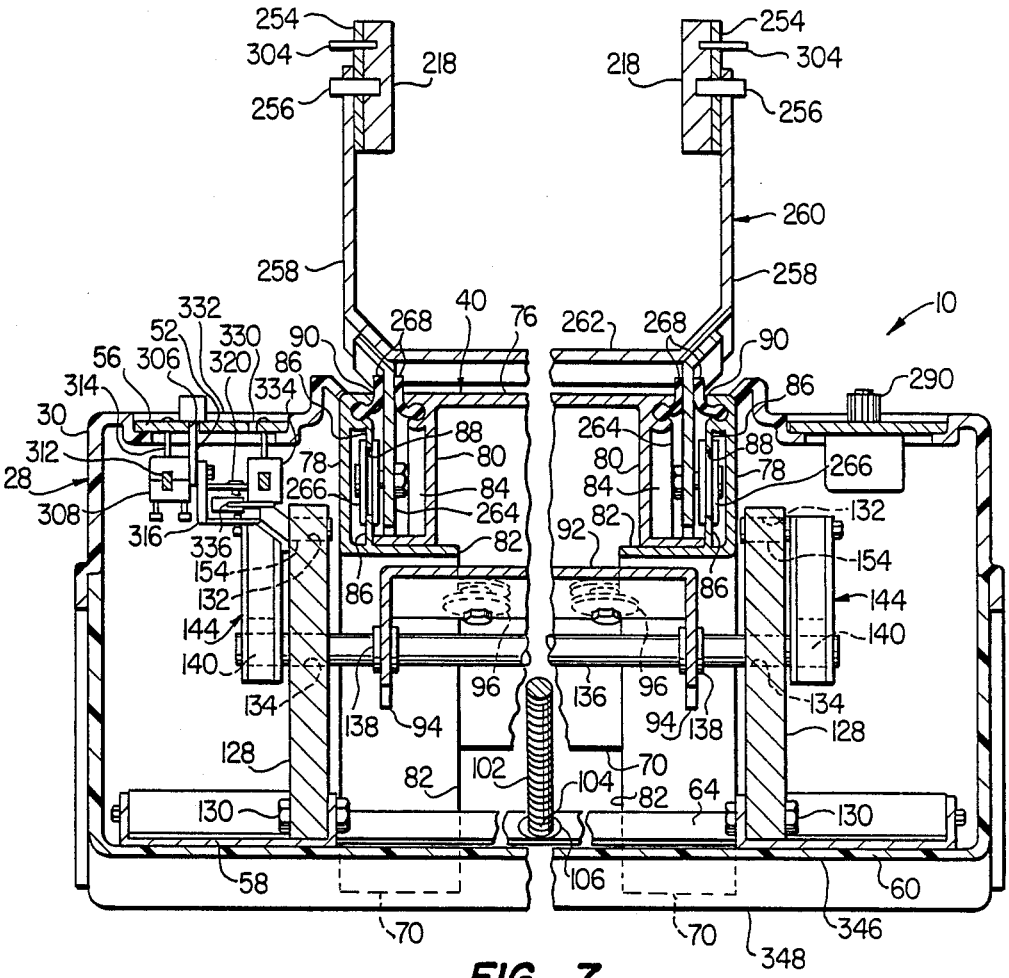
FIG. 7 is an enlarged scale, horizontally foreshortened cross-sectional view through the exerciser taken generally along line 7—7 of FIG. 2.
Figure 8:
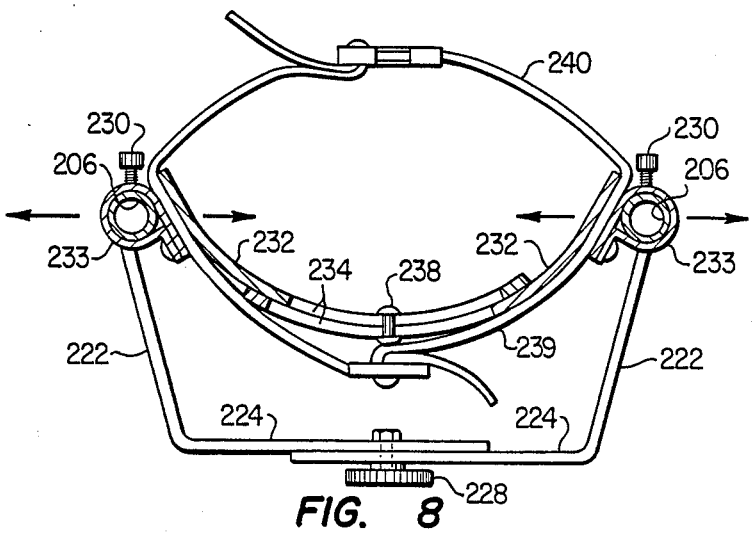
FIG. 8 is an enlarged scale cross-sectional view taken through the leg support frame structure portion of the exerciser taken along line 8—8 of FIG. 2.

As is best illustrated in FIGS. 5 and 7, the inclined guide member 40 is generally channel-shaped in cross-section, having an upwardly facing base portion 76 of elongated rectangular configuration, a pair of spaced apart outer and inner flange portions 78, 80 depending from opposite side edge portions of the base 76, and a pair of horizontally inturned, spaced apart flange portions 82 projecting inwardly from the lower ends of the flanges 78. As previously mentioned, the guide member 40 is horizontally inclined at an angle of 20° relative to the horizontal. Each of the flange pairs 78, 80 defines therebetween an inclined chamber 84 in which is disposed a pair of small opposed flanges 86 which form horizontally inclined tracks 88 within the chambers 84. Formed along the length of the base portion 76 of guide member 40 are a pair of spaced apart, parallel slots 90 (FIG. 1) which extend generally along the entire length of such base portion 76.

Exerciser 10 is also provided with a generally rectangularly-shaped drive plate member 92 (FIG. 6) having flanges 94 depending from opposite side portions thereof. Rotatably mounted on the upper surface of the drive plate 92 adjacent its four corners are four generally pulley-shaped guide wheels 96. As best illustrated in FIG. 7, these guide wheels receive side edge portions of the inclined lower guide member flanges 82 to thereby mount the drive member on the underside of the guide member 40 for upwardly and downwardly inclined movement along its length.

At the front or right end of the drive plate 92 (as viewed in FIG. 6) is secured an elongated rectangular plate member 98 which has operatively secured to a central portion thereof a hollow cylindrical, internally threaded drive nut member 100. Nut 102 is threaded onto an elongated, externally threaded lead screw member 102 which is positioned below and extends parallel to the inclined guide member 40. The lower rear end 10 of lead screw 102 is rotatably supported in a suitable bushing member 106 (FIG. 7) carried by the crossbrace member 64. Lead screw 102 is selectively driven in opposite rotational directions by a reversible motor 108 mounted on a sloping support plate member 110 which is secured to the front support frame 74 in a spaced apart relationship therewith by suitable resilient mounting elements 112. Motor 108 is utilized to rotationally drive the lead screw 102 via a double reduction drive system interconnected between the motor and the lead screw.

Such drive system includes a small diameter pulley 114 connected to the drive shaft of the motor and positioned between the support plate 110 and the frame 74, a larger diameter pulley 116 positioned between the plate 10 and the frame 74 and connected to the pulley 114 by a drive belt 118, a smaller diameter pulley 120 positioned on the motor side of the plate 110 and connected to the pulley 116 by a shaft (not shown), and a larger diameter final drive pulley 122 rotatably mounted on the motor side of the plate 110 and interconnected to the pulley 120 by a drive belt 124. The final drive pulley 122 is fixedly secured to an upper forward end portion 126 of the lead screw 102. As viewed from the pulley end of the lead screw 102 in FIG. 6, clockwise rotation of the lead screw causes the drive plate 92 to be driven rightwardly and upwardly along the underside of the guide member 40, while counterclockwise rotation of the lead screw moves the drive member 92 downwardly and rearwardly along the guide member.

Also disposed within the housing 30 are a pair of upstanding cam plate members 128 which are positioned on opposite sides of the guide member 40. Lower side edge portions of the cam plate members are secured to the base frame members 58, 60 as by bolts 130. Formed through upper side edge portions of the cam plate members 128 are upwardly curved cam slots 132. Also formed through the cam plate members 128, beneath the cam slots 132, are essentially straight lower cam slots 134 which extend parallel to the guide member 40 (as may best be seen in FIGS. 9–11) and extend rearwardly and downwardly beyond the upper cam slots 132.

A cylindrical shaft 136 is extended through suitable bushing elements 138 carried by the drive plate flanges 94, and extends outwardly through the lower cam slots 134 in the cam plate members 128. Outer end portions of the shaft 136 are rotatable received in cylindrical bushing elements 140 carried by rearwardly facing corner portions 142 of a pair of generally triangularly shaped torque arm members 144 positioned outwardly adjacent the cam plate members 128. Each of such torque arm members 144 comprises a pair of generally triangularly shaped plates 146 having disposed between a forward end portion thereof a spacing member 148. Small shafts 150 are extended inwardly through forward corner portions 152 of the torque arm members 144 and have inner end portions received in cylindrical bushing members 154 movably carried within the upper cam slots 132.

The previously mentioned linking arm structure housed within the elongated linkage shrouds 46 (FIG. 1) comprises a pair of elongated push rod members 156 positioned on opposite sides of the cam plate members 128 and a pair of elongated linking arm members 158 positioned directly beneath and extending parallel to the push rods 156. The right or inner ends of the push rods 156 are gimballed to the torque arm members 144 by means of small eyed screw members 160 connected to the inner ends of the push rods and extending into the torque arm members 144 between their plates 146 adjacent an intermediate corner portion 162 of the torque arm members. The screw members 160 are pivotally connected to the torque arm members by means of small connecting bolts 164 which are extended through suitable openings 166 formed through the torque arm plates 146 as illustrated in FIG. 6. The right or inner ends of the linking arms 158 are suitably notched to form yokes 166 which straddle the torque arm bushings 140 and are gimballed thereto by pairs of screws 168 which are extended through the arms of the yokes and into the bushings 140.

Secured to the lower side surfaces of the rectangularly cross-sectioned support arms 158 adjacent the end yokes 166 are elongated cam members 170 which extend parallel to the linking arms 158 and have downwardly curved lower side surfaces 172. Interconnected between the opposite ends of each cam 170 is a restraining strap 174.

As is best illustrated in FIG. 5, the left or outer ends of the linking arms 158 are suitably recessed to define yokes 176 which receive lower end portions of two generally L-shaped pivot gimbal plates 178. Such lower end portions of the pivot gimbal plates are pivotally connected to the yokes 176 by pivot pins 180 (only one of such pivot pins being visible in FIG. 5). The left or outer ends 181 of the push rods 156 are pivotally connected to the pivot gimbal plates 178 by means of pivot pins 182. Fixedly secured to the laterally inwardly facing surfaces of the pivot gimbal plates 178 for movement therewith are a pair of connecting members 184 having circular bores 186 formed therethrough.

Adjacent the outer end yokes 176, the linking arms 158 are intersecured by a pair of generally L-shaped adjustment members 188 which are secured to the linking arms and having overlapping leg portions 190. The threaded end of a locking screw member 192 is extended through a slot 194 formed in the upper leg member 190 and is threaded into the lower leg member 190. By loosening the locking screw 192 the linking arm member pairs 156, 158 (which are positioned on opposite sides of the exercised leg 16) may be laterally pivoted relative to each other about their gimballed forward end connections to the torque arm members 144 to provide for legs width adjustment as subsequently described. Such lateral pivoting of the arm pairs 156, 158 causes the overlapping legs 190 of the adjustment members 188 to slide relative to one another. When the arm pairs 156, 158 are suitably adjusted, the locking screw 192 may retightened to hold the arm pairs in their adjusted position.

Referring now to FIGS. 1–3 and 5, the leg support frame structure 50, to which the exercised leg 16 may be operatively connected, comprises two spaced apart pairs of telescopingly engaged thigh support tubes 196 and 198. The outer ends 200 of the tubes 196 are received and locked within the bores 186 of the connecting members 194. Secured to the outer ends 202 of the tubes 198 are a pair of small connecting tabs 204. The telescoped tubed pairs 196, 198 define an end portion of the leg support frame structure 50 which may be adjusted in length by means of locking screws 206 which are operative to permit the tubes 198 to be locked at predetermined locations along their corresponding tubes 196.

The support frame structure 50 also includes oppositely disposed pairs of telescopingly engaged calf support tubes 206 and 208. Yoked outer ends 210 of tubes 206 are pivotally connected to the connecting tabs 204 at points 212 which may be aligned with the knee joint 14 of the supported leg 16.

The outer ends 214 of the tubes 208 are extended through silently elongated periperal slots 216 formed in a pair of generally disc-shaped pivot members 218. The outer tube ends 214 are laterally pivoted within the pivot members 218 by means of a pair of connecting pins 220. The elongated slots 216 permit the telescoped tubed pairs 206, 208 to be laterally pivoted toward and away from each other about the pivot pins 220.

The tubes 206 are interconnected by a pair of generally L-shaped adjustment members 222 secured to the tubes 206 and having overlapping leg portions 224. The lower leg 224 has a slot 226 formed therethrough. A locking bolt member 228 is extended upwardly through the slot 226 and is threaded into the uppe leg 224. By loosening the screw 228 the tube pairs 206, 208 (which, like the tube pairs 196, 198, are positioned on opposite sides of the exercised leg 16) may be selectively pivoted toward or away from each other about the pivot pins 220 to provide for leg width adjustment, and the screw 228 retightened to lock the tube pairs 206, 208 in a predetermined laterally pivoted relative orientation.

It can be seen that by loosening the screw members 192 and 228 the relative lateral spacing of the opposite side portions of both the linking structure and the leg support frame structure maybe selectively adjusted. Retightening of the screw members 192 and 228 then quickly locks such opposite side portions in the adjusted position. It can also be seen that the telescopingly engaged tube pairs 206, 208 define an end portion of the leg support frame structure 50 whose length may be selectively adjusted by axially moving the tubes in each pair thereof to one another. Each of the tubes 206 may be locked in its longitudinally adjusted position to its corresponding tube 208 by means of a locking screw member 230.

Referring now to FIGS. 1–3 and 8, the tubes 206 are intersecured by a pair of curved, overlapping calf support cradle members 232, each of which is connected to one of the tubes 206 by clamp members 233. These cradle members 232 serve to support the lower leg portion 26 and provides a depth adjustment thereof. Two pairs of aligned slots 234, 236 are formed through the cradle members 232 and are maintained in alignment by a pair of alignment pin members 238 extending through each of the slot pairs. The cradle members 232 are flexible and may be moved relative to one another to increase or decrease the distance that they extend below the tubes 206.

Also connected to the tubes 206 are a pair of leg support straps 238 (FIGS. 2 and 3) which extend beneath the cradle members 232 and may be adjusted to maintain the predetermined depth of such cradle members. A third leg strap 240 is also interconnected between the tubes 206 and is securable over the upper surface of the supported lower leg portion 26 to hold it in the cradle members 232.

Similarly depth-adjustable overlapping curved thigh support cradle members 242 are secured to the tubes 198, and serve to support the upper leg portion 24 as illustrated in FIGS. 2 and 3. To maintain the overlapping support cradle members 242 in their depth-adjusted position, a leg strap member 244 is provided which is interconnected between the cradle members 242 and passes beneath them. Also interconnected between the tubes 198 is an adjustable securing strap member 246 which passes over the upper leg portion 24 as illustrated in FIGS. 2 and 3. For illustrative clarity, the cradle members 232 and 242 have been omitted from FIG. 5.

Referring now to FIGS. 1–3 and 5, the leg support frame structure 50 is also provided with a generally U-shaped foot support bracket 248 having a base portion 250 (FIG. 5) to which the lower end of an elongated rectangular foot support plate 252 is secured. Extending outwardly from the outer ends of the base 250 are a pair of bracket arms 254 which are pivotally connected to the pivot members 218 by means of a pair of pivot pins 256, only one of the pivot pins 256 being illustrated in the drawings. Pins 256 also pivotally connect the outer ends of the arm portions 258 of a generally U-shaped connecting bracket member 260 which has a base portion 262. Depending from the bracket base 262 and extending downwardly through the guide member slots 90 (FIG. 1) are a pair of connecting plates 264.

Referring now to FIG. 7, the connecting plates 264 extend into the inclined guide member chambers 84 and have secured thereto generally pulley shaped guide wheels 266. Each of the plates 264 has three of the wheels 266 connected to it, each of such wheels being operatively carried in the inclined guide member tracks 88. Accordingly, the connecting bracket member 260 is freely movable upwardly and downwardly along the inclined guide member 40. To prevent foreign objects from falling through the guide member slots 90 into the chambers 84, pairs of elongated resilient seal strips 268 are connected to the guide member 40 within the chambers 84 and extend outwardly through the slots 90 and along opposite side surfaces of the plates 264 as indicated in FIG. 7.

The leg 16 to be passively exercised is secured to and aligned with the exerciser 10 in the following manner. The leg is positioned within the support frame structure 50 (FIGS. 2 and 3) so that the upper leg portion 24 rests upon the overlapping cradle members 242, and the lower leg portion 26 rests upon the overlapping cradle member 232. A hip joint alignment tube 270 is pushed onto the outer end 200 of the right thigh support tube 196 (as viewed in FIG. 5) and has an outer end portion 272 which, by appropriately moving the housing 30, is brought into alignment with the hip joint 12 of the leg 16. The width of the support frame structure 50 is adjusted to comfortably fit the width of the leg 16 by loosening the screw members 192 and 228 (FIG. 5) and horizontally pivoting the linkage shrouds 46 toward or away from each other as required. The shrouds 46 are secured to the support arms 158 for movement therewith and enclose the linking arm members 156, 158. This lateral adjustment of the shrouds 46 concomitantly adjusts the lateral spacing between the opposite side portions of the support frame structure 50 defined by the interconnected support tubes positioned on opposite sides of the leg 16. The lateral positions of the shrouds 46 and the side portions of the support frame structure 50 may be fixed by simply tightening the screw members 192 and 228. Leg depth adjustments may easily be made by loosening the straps 239 and 244, relatively adjusting the cradle member pairs 232 and 242 and then retightening the straps 239 and 244.

With the outer end 272 of the alignment tube 270 properly aligned with the hip joint 12, the screws 206 are loosened and the tubes 198 moved along the tubes 196 until the frame pivot point 212 is brought into alignment with the knee joint 14. After the tube 270 has been used to align the exerciser 10 with the hip joint 12, it may be removed during operation of the exerciser.

The foot and ankle portions of the leg 16 are supported within the frame structure 50 by means of a foot and ankle support pad 274 which is adjustable to comfortably secure the foot and ankle portions of the leg to the support frame structure 50. Pad 274 has a first portion 276 which extends along the inner surface of the foot support plate 252 and a second portion 278 and is connected to the first portion 276. The first pad portion 276 has a connecting loop 280 formed thereon which slips over the upper end of the foot support plate 252. The pad portion 276 also has secured thereto a strap 282 which extends over the upper end of the foot support plate 252 and is adjustably securable, by means of cooperating hook and pile fastening surfaces to a fastening strip 284 secured to the rear surface of the foot support plate 252. By disconnecting the strap 282 from the fastening member 284 the pad portion 276 may be moved upwardly or downwardly along the foot support plate to selectively adjust the height of the second pad portion 278. The pad portion 276 may be selectively locked in its adjusted position by simply resecuring the strap 282 to the attachment member 284. The second pad portion is secured to the support tubes 208 in its adjusted position in which it cradles the ankle portion of the supported leg by means of a pair of support straps 286 which are looped over the support tubes 208 and secured to themselves by appropriate hook and pile fastening means. The first pad portion 276 is provided with elongated relatively narrow side portions 288 which wrap around the foot 20 and are secured around the foot by cooperating hook and pile fastening elements 290, 292 secured to the portions 288.

In securing the leg 16 within the support frame structure 50, the tube screws 230 are loosened and the tube pairs 206, 208 are longitudinally adjusted so that the pad portion 276 is brought firmly up against the bottom of the foot 20 and the pivot pin 256 is aligned with the ankle joint 22. When these comfort and alignment adjustments are made, the upper leg straps 240 and 246 are appropriately tightened around the supported leg. It will be appreciated that, if desired, appropriate padding members may be placed between the cradle members 232, 244 and the supported leg. Such padding members have been eliminated from the drawings for illustrative clarity.

The result of these alignment and comfort adjustments is that the exerciser points 272, 212, and 256 are respectively aligned with the hip joint 12, the knee joint 14, and the ankle joint 22. Additionally, the tube pairs 196, 198 and 206, 208 are generally laterally centered along the upper and lower leg portions 24 and 26 as depicted in FIGS. 2 and 3.

With the leg 16 being operatively connected to the exerciser 10, an appropriate range of hip joint flexure, and a corresponding range of directly correlated knee joint flexure, is quickly set simply by appropriately positioning the control levers 52 and 54 (FIG. 1) as subsequently described. A desired motor speed is then selected by appropriately adjusting a speed control knob 290 positioned on a control panel 292 on the upper surface of the housing 30 and a power switch 294 is activated to energize the motor 108. Energizing the motor 108 causes a cooperative cyclical motion of the previously described components of the exerciser 10 in a manner which will now be described in detail with reference to Figs. 9-11. By virtue of a unique cooperation between such components, the geometry of the resulting leg flexure previously described with reference to FIG. 4 is maintained along with the correlation between the hip flexure angle and knee flexure angle which is essentially independent of the length of the supported leg.

Figure 9:
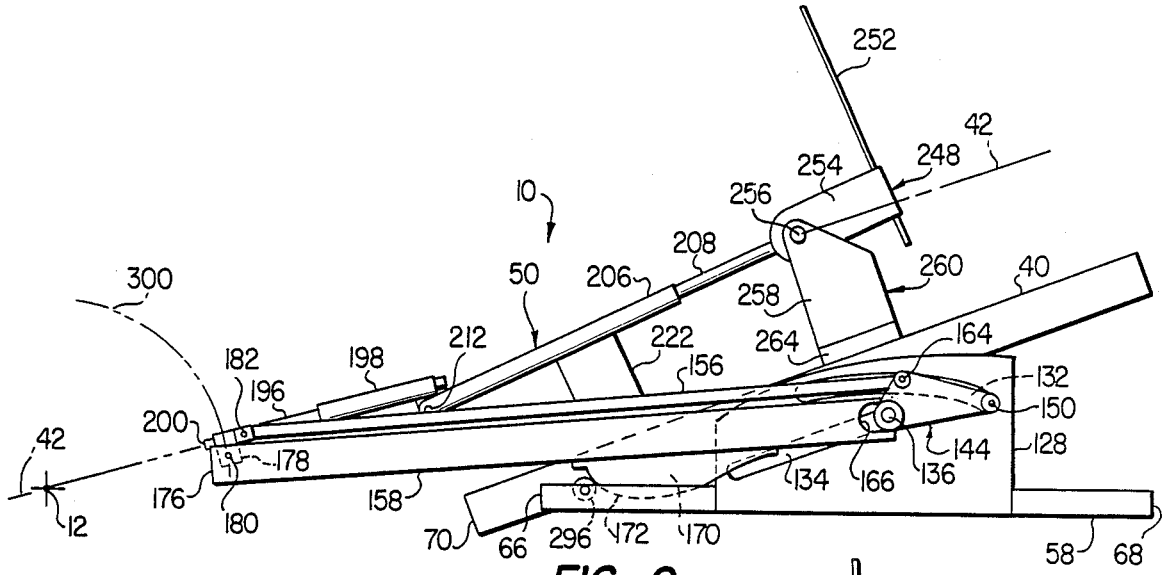
FIGS. 9, 10 and 11 are simplified and somewhat scalealtered diagrammatic side elevational views of the drive, linkage and leg support structure portions of the exerciser, and sequentially illustrate the relative positional orientations of such structures as the patient's leg is being cyclically flexed by the exerciser.
Figure 10:
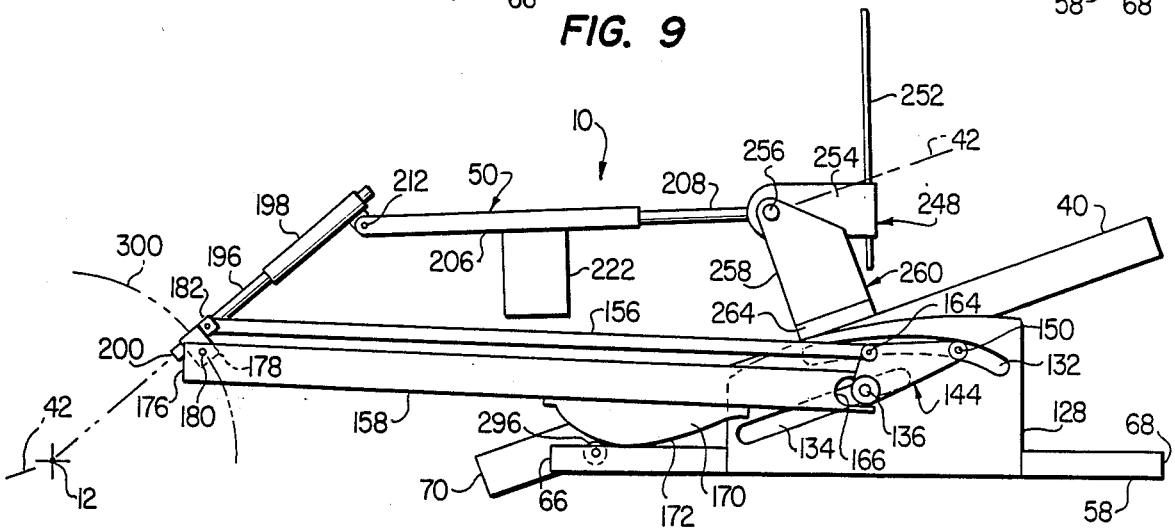
Figure 11:
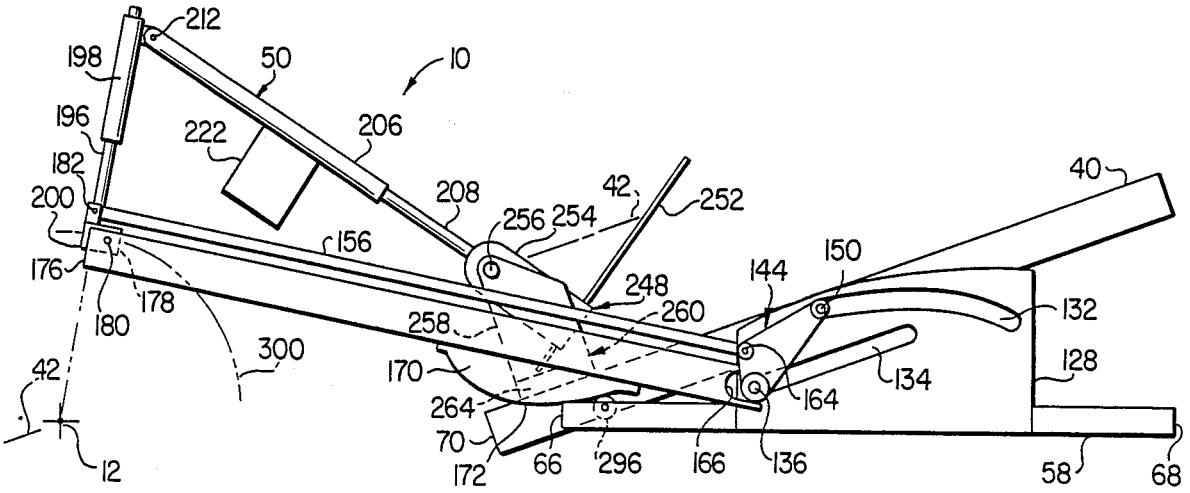

For purposes of illustration, FIG. 9 schematically illustrates various components of the exerciser 10 in the positions which they assume at one end of the maximum stroke of the exerciser, FIG. 10 depicts the components at an intermediate portion of such maximum stroke, and FIG. 11 schematically depicts the components in the positions which they assume at the opposite end of the maximum stroke of the exerciser 10. It will be appreciated, however, that the exerciser may be selectively adjusted as subsequently described to operate along any selected portion of such maximum stroke.

In FIG. 9 the leg support frame structure 50 is in its fully extended position. It should be noted that in this fully extended position the support tubes 198 and 206 have been relatively pivoted to a slightly hyperextended angle. This feature of the present invention assures that the supported leg can be driven by the support frame structure to its fully extended position if desired despite a slight compression of the calf muscle area by the cradle members 232 (FIG. 1) as the leg approaches its fully extended position. With the leg support frame structure in this position, the connecting bracket member 260 is at its uppermost position along the inclined guide member 40, the shafts 150 are at the rightmost ends of the upper cam slots 132, and the drive member shaft 136 is at the rightmost end of the lower cam slot 134. As the lead screw member 102 (FIG. 6) is rotated in a counterclockwise direction (as viewed from the pulley end of the lead screw in FIG. 6) by the motor 108, the drive member 92 is forced downwardly and forwardly along the inclined guide member 40. Such motion of the drive member 92 forces the shaft 136 downwardly and forwardly along the cam slot 134. Such movement of the shaft 136 pulls the torque arm members 144 leftwardly and causes leftward movement of the shafts 150 along the upper curved cam slots 132. The leftward movement of the shafts 136 and 150 causes the push rods 156 and the linking arms 158 to be pushed leftwardly. Movement of the shafts 150 along the curved upper cam slot 132 simultaneously pivots the torque arm members 144 in a counterclockwise direction around the drive member shaft 136.

As illustrated in FIG. 10, this motion of the torque arms 144, which leftwardly translates the push rods 156 causes a counterclockwise rotation of the pivot gimbal plates 178 about the pivot points 180 adjacent the yoked outer ends 176 of the linking arms 158. Simultaneously, the linking arms 158 are being translated leftwardly. During this translation of the linking arms 158, the lower surfaces 172 of the linking arm cams 170 are rolled along small rollers 296 secured to base frame members 58, 60 adjacent their back ends 66. The interaction between the curved lower cam surfaces 172 and the rollers 296 causes the linking arms 158 to be pivoted in a clockwise direction about the drive member shaft 136 while they are being leftwardly translated.

The result of this simultaneous translation and pivoting of the linking arms 158 is that the outer end portions 176, 200 of the linking arms 158 and the support tubes 196 are moved in a circular arc 300 which is centered about a line extending transversely through the hip joint 12. Specifically, this line extends generally through the hip joint 12 of the representative right leg 16 being exercised, and through the hip joint of the left leg which is positioned behind the leg 16 in FIGS. 2 and 3.

Further rearward and downward motion of the drive member along the inclined guide member 40 moves the illustrated components of the exerciser 10 to the opposite end of their maximum stroke as depicted in FIG. 11. At this end of the maximum stroke the shafts 150 have been moved to the left end of the curved upper cam slot 132, and the drive member shaft 136 has been moved to the left end of the lower cam slot 134.

The previously described movement of the push rods 156, which are maintained in a parallel relationship with the linking arms 158, pivotally drives the support tubes 196 in a counterclockwise direction about the linking arm pivot points 180. This pivotal motion of the tubes 196 is achieved in a manner which keeps the outer ends 200 of the tubes 196 pointed directly at the line which extends transversely through the hip joint 12. The simultaneous pivoting and translation of the tubes 196 in this manner functions to move each point in the tube pairs 196, 198 (which define an end portion of the articulated support frame structure 50) in a circular arc which is centered about the line extending transversely through the hip joint 12.

The pivoting of the tubes 196 caused by the push rods 156 also causes pivoting of the leg support frame structure 50 about its knee pivot point 212 so that the connecting bracket member 260 is pulled downwardly along the inclined guide member 40 to the position of the bracket 260 depicted in FIG. 11. When the illustrated components of the exerciser 10 reach their positions indicated in FIG. 11, the motor 108 (FIG. 6) is automatically reversed in a manner subsequently described to return the components to their positions depicted in FIG. 9 (through the component positions depicted in FIG. 10) to unflex the supported leg.

As previously mentioned, during operation of the exerciser 10 the motion of the ankle joint 22, which is aligned with the pin 256, is maintained along the line 42 which extends through the hip and ankle joints 12, 22 of the supported leg 16. As is best illustrated in FIG. 5, the straps 174 which are connected between the opposite ends of the cam members 170, are passed under the rollers 296, such straps functioning to limit the clockwise pivotal motion of the linking arms 158 during, for example, transport of the exerciser. Otherwise, such straps 174 play no role in the driven motion of the linking structure.

Figure 12:
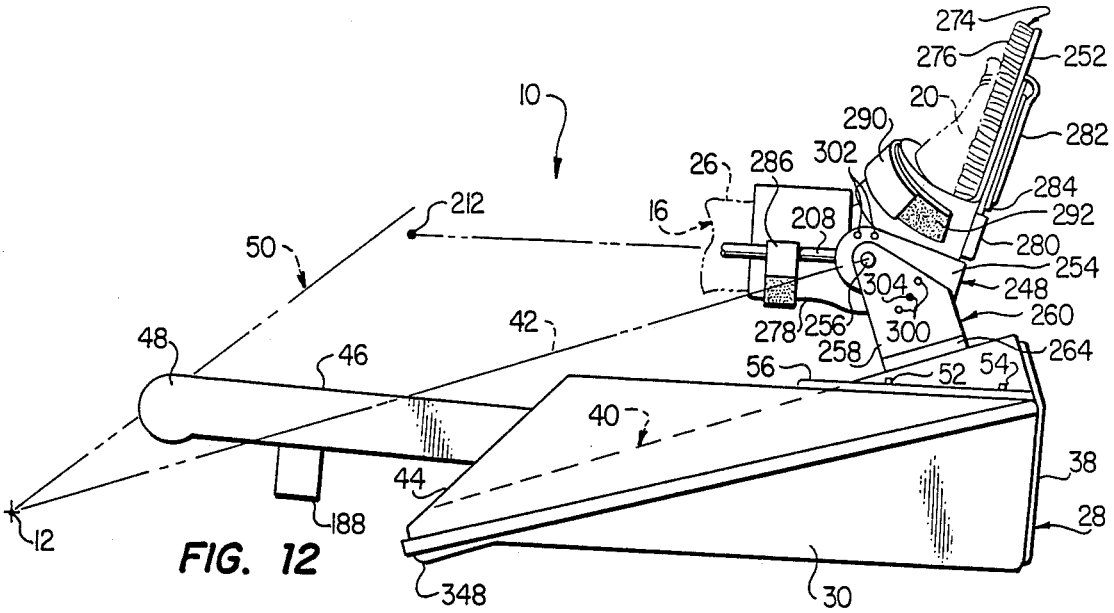
FIGS. 12 and 13 are reduced scale, partially schematic side elevational view of the exerciser, and sequentially illustrate the operation of an adjustable foot and ankle support portion of the leg support frame structure during passive flexure of the exercised leg.
Figure 13:
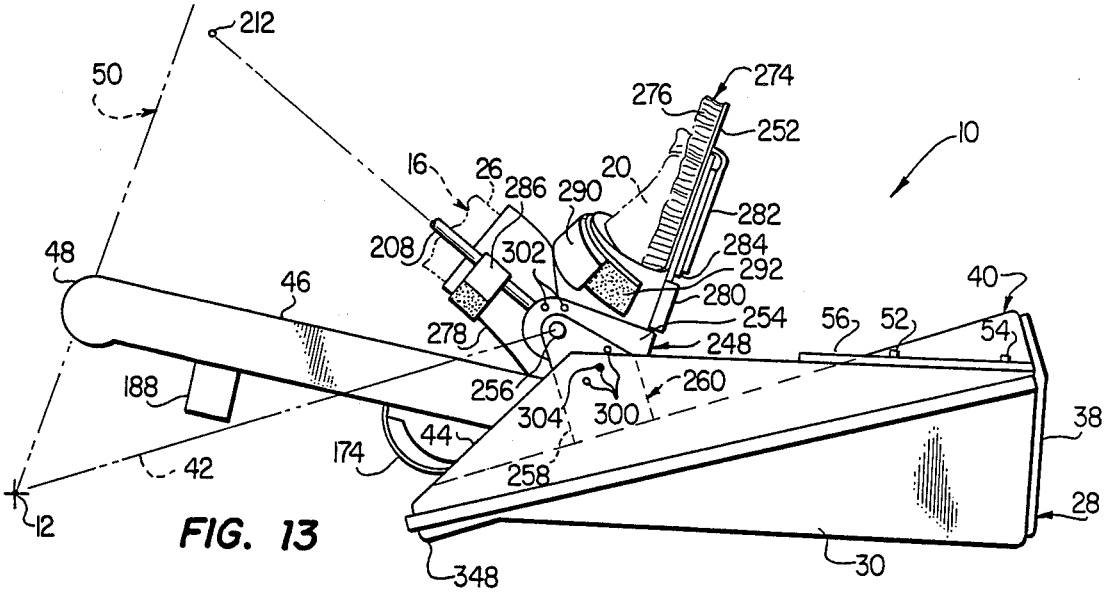

With reference now to FIGS. 12 and 13, the exerciser 10 also has incorporated therein a unique feature which permits control of the degree of flexure of the ankle joint 22 as the leg 16 is being passively flexed. To provide this desirable control of the flexure of the ankle joint, a series of circular holes 300 are formed through the arm portions 258 of the connecting bracket member 260, each of the holes 300 being alignable with corresponding circular holes formed through the arm portions 254 of the foot support bracket 248. Additionally, a pair of circular holes 302 are formed through the arm portions 254 of the foot support bracket 248, each of the holes 302 being alignable with a corresponding circular hole formed in each of the disc-shaped pivot members 218.

By inserting locking pin members 304 through selected ones of the holes 300 into the corresponding hole in the bracket arms 254 the bracket members 248 and 260 are prevented from rotating relative to one another during flexure of the supported leg 16 as depicted in FIGS. 12 and 13. However, as the leg 16 is flexed by the exerciser 10, with the brackets 248 and 260 locked together in this manner, the upper leg portion is pivoted about the ankle joint relative to the foot 20 to provide a predetermined range of ankle joint flexure as illustrated in FIGS. 12 and 13.

If the locking pin members 304 are each inserted instead through a selected one of the holes 302 in the arms 254 into the corresponding holes in the pivot members 218, the brackets 248, 260 are free to pivot relative to one another about the pins 256, but the bracket 248 is locked to the pivot members 218 with the foot 20 being locked against pivotal movement relative to the lower leg portion 28. Accordingly, as the supported leg 16 is being flexed by the exerciser 10 as depicted in FIGS. 2 and 3, the ankle joint 22 is locked against pivotal movement.

Figure 14:
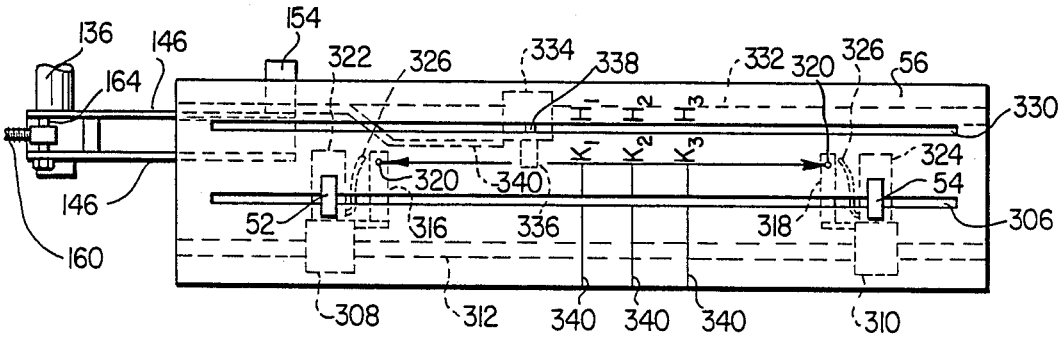
FIG. 14 is simplified, enlarged scale top plan view of a leg flexure adjustment panel portion of the exerciser, and schematically illustrates the operation of an automatic stroke limit control system portion of the exerciser disposed beneath such panel portion.

As previously mentioned, the motor 108 (FIG. 6) is automatically reversed as the opposite ends of a predetermined hip joint angular flexure range are reached. The mechanism by which this automatic motor reversal is achieved will now be described with reference to FIGS. 5, 7 and 14. The control adjustment levers 52 and 54 extend downwardly through an elongated slot 306 formed through the limit control panel 56. Respectively secured to the lower ends of the control levers 52, 54 are support blocks 308 and 310 which slide along a rectangularly cross-sectioned support rod 312 which is secured to the underside of the panel 56 by connecting screws 314. The support blocks 308, 310 have respectively mounted thereon optical position sensor switches 316 and 318 which, as schematically indicated in FIG. 14, face each other and generate small light beams 320. Also carried on the support blocks 308, 310 for movement therewith along the support rod 312 are a pair of mechanical limit switches 322, 324 which are positioned longitudinally outwardly of the optical switches 316, 318 and have actuating levers 326. It can be seen that by moving either of the control levers 52, 54 along the slot 306 the lever's associated optical and mechanical switches may also be repositioned along such slot. The switches 316, 318 and 322, 324 are appropropriately wired to the motor 108 through a motor control circuit box 328 (FIGS. 5 and 6) disposed within the housing forwardly of the front support frame 74.

The panel 56 is also provided with a second elongated slot 330 which extends parallel to the slot 306. Positioned beneath the slot 330, and extending parallel thereto is a rectangularly cross-sectioned support rod 332 which is secured to the panel 56 by screws 334. Slidably supported on the rod 332 for movement along its length is a support block 334 having a horizontally projecting tab member 336 and an upwardly projecting position indicating member 338 which extends upwardly through the slot 330.

An elongated, laterally offset connecting arm 340 (FIGS. 5 and 6) is pivotally connected at one end to the shaft 150 of the torque arm member 144 positioned to the right in FIGS. 5 and 6. The opposite end of the arm 340 is pivotally connected to the support block 334. Accordingly, when the drive member 92 is cyclically motor-driven along the guide member 40, the corresponding movement of the right torque arm member 144 drives the support block rightwardly or leftwardly along the support rod 332. As the support block tab 336 passes through one of the optical switches 316, 318 it breaks the light beam 320 of the switch and the switch automatically reverses the motor 108 which reverses the direction of travel of the drive member 92. This, in turn, moves the support block toward the other optical switch. In the event that one of the optical switches 316, 318 becomes inoperative, the tab 336 moves slightly past the beam location 320 and engages the corresponding mechanical limit switch actuating lever 326 to cause reversal of the motor 108. It can accordingly be seen that the mechanical switches 322, 324 function as safety backup switches for the optical switches 316, 318.

Along its length, the panel 56 is provided with a spaced series of transversely extending calibration lines 340 (only three of which are illustrated in FIG. 14). Suitably marked on the panel 56, and appropriately aligned with the calibration lines 340, are hip joint flexure angle indication marks $H_1$–$H_3$ and corresponding knee joint flexure angle marks $K_1$–$K_3$. To rapidly calibrate the exerciser 10, the control levers 52, 54 are simply moved along the slot 306 until they are aligned with appropriate ones of the calibration lines 340 which correspond to the desired flexural range for the hip joint flexure, and the corresponding range for knee joint flexure. For example, if it is desired to cyclically flex the knee joint between a 20° flexural angle and a 90° flexural angle, the control levers 52, 54 are simply moved into alignment with the two lines 340 upon which are marked the knee flexure angles 20° and 90°. Such movement of the control levers 52, 54 appropriately positions their optical and mechanical limit switches such that the movement of the support block 334 will be automatically reversed each time the tab member 336 activates one of the limit switches to cause corresponding reversal of the motor 108.

This simple procedure is all that is necessary to rapidly calibrate the exerciser 10 to provide a predetermined flexural range for both the hip and knee joints. There is no necessity to actually measure the knee flexure range and, by trial and error, reset the limit controls. This very beneficial feature of the exerciser 10 arises, of course, from the unique motion imparted to its various components, as previously described, which maintains a predetermined correlation between the hip flexure angle and the knee flexure angle regardless of the length of the leg being cyclically flexed by the exerciser 10.

Movement of the pointer member 338 along the slot 330 provides a constant visual indication of both the hip flexure angle and the knee flexure angle. As the tab member 336 is being driven between the opposed pairs of limit switches to automatically reverse the motor 108 at the opposite ends of the preselected "stroke" range of the exerciser. While the limit control system just described provides for automatic operation of the exerciser 10, the exerciser may be easily converted to manual operation simply by reversing the position of an auto-manual switch 342 (FIG. 5) and then utilizing a two position switch 344 to manually cause reversal of the motor 108. The switches 342 and 344, like the switch 294 and the motor speed control knob 290, are appropriately wired to the motor 108 through the motor control box 328.

Referring again to FIG. 3, while the bottom surface 346 of the housing 30 is essentially flat along most of its length, a rear end edge portion 348 projects downwardly from the bottom surface 346. End edge portion 348 tends to concentrate a portion of the weight of the exerciser 10 along a rear edge portion of the housing 30 to thereby cause the end portion 348 to sink into the mattress 18 as illustrated. This feature tends to impede the right-to-left motion of the housing 30 to thereby positionally stabilize the exerciser 10 relative to the patient. Additionally, as the leg 16 is being flexed by the exerciser 10, the leg's center of gravity is constantly being shifted. This shifting of the leg's center of gravity tends to pivot a lower portion of the patient's body about a horizontal axis and cause the hip of the exercised leg to sink further into the mattress. The downturned housing end portion 348 functions to facilitate a corresponding further lowering of the front end of the housing 30 into the mattress to maintain an even more precise alignment between the exerciser and the leg 16 being cyclically flexed.

It can be seen from the foregoing that the present invention provides a passive motion exerciser which has a variety of advantages over conventional mechanical leg exercisers. Because the exerciser 10 uniquely maintains a predetermined correlation between the hip and knee flexure angles which is essentially inependent of the length of the leg being exercised, it may be far more easily and quickly calibrated. Additionally, the exerciser 10 provides significantly enhanced patient leg comfort due to the ability of its linkage structure and leg support frame structure to be laterally adjusted to accommodate legs of varying thicknesses. The depth adjustability of the leg support frame structure also enhances patient comfort. The ability of the exerciser 10 to selectively control the degree of ankle joint flexure during flexure of the hip and knee joints further increases the usefulness and flexibility of the exerciser.

Finally, the exerciser 10 uniquely solves yet another problem commonly associated with various conventional mechanical leg exercisers in that it may be rapidly changed over to the patient's opposite leg (i.e., the left leg in FIGS. 2 and 3) without the previous necessity of disassembling and then reassembling various components of its linkage structure. All that is necessary with the exerciser 10 is to simply disconnect it from the leg 16, move it over to the other leg, and secure the other leg to the exerciser as previously described.

The foregoing detailed description is to be clearly understood as being given by way of illustration and example only, the spirit and scope of the present invention being limited solely by the appended claims.

What is claimed is:

1. Apparatus for passively exercising a human leg having a hip joint, a knee joint, an ankle joint, an upper leg portion extending between said hip joint and said knee joint, and a lower leg portion extending between said knee joint and said ankle joint, said apparatus comprising:

a base portion;

first support means for extending along and supporting said lower leg portion for movement therewith, said first support means having a portion positionable closely adjacent said ankle joint;

connecting means for connecting said portion of said first support means, and thus said ankle joint, to said base portion for movement relative thereto in opposite directions along an essentially straight line;

second support means for extending along said upper leg portion for movement therewith, said first support means and said second support means being pivotally interconnected at a location positionable adjacent said knee joint; and means for driving said second support means to cause said first support means and said second support means to cyclically flex and unflex said hip joint and said knee joint in a manner such that:

said essentially straight line along which said ankle joint travels in opposite directions extends at all times through said hip joint, said second support means are moved in an arc generally centered about a line extending transversely through said hip joint, and a predetermined, essentially linear correlation is maintained between the hip flexure angle of said human leg and the knee flexure angle of said human leg, said correlation being essentially independent of the length of said human leg.

2. The apparatus of claim 1 wherein:

said means for driving said second support means include a drive member movably connected to said base portion, and drive means for selectively driving said drive member in opposite directions along an essentially linear path generally parallel to a line extending through said hip joint and said ankle joint when said human leg is operatively supported on said first support means and said second support means.

3. The apparatus of claim 2 wherein:

said portion of said first support means is an outer end portion thereof which is positionable adjacent said ankle joint, and said connecting means connect said outer end portion of said first support means to said base portion for movement relative thereto in opposite directions generally parallel to said essentially linear path of said drive member.

4. The apparatus of claim 1 wherein:

said means for driving said second support means include a drive member movably connected to said base portion, drive means selectively operable to translate said drive member in first and second opposite directions relative to said base portion, and linking means interconnected between said drive member and said second support means for causing simultaneous translation and pivoting of said second support means in response to translational movement of said drive member relative to said base portion.

5. The apparatus of claim 4 wherein:

said second support means have an end portion positionable adjacent a longitudinally intermediate section of said upper leg portion, and said linking means function to simultaneously move said second support means in an arc generally centered about a line extending transversely through said hip joint and pivot said second support means in a manner such that said end portion of said second support means continuously points at said line extending transversely through said hip joint.

6. Apparatus for passively exercising a human leg having a hip joint, a knee joint, an ankle joint, an upper leg portion extending between said hip joint and said knee joint, and a lower leg portion extending between said knee joint and said ankle joint, said apparatus comprising:

a base portion;

first support means for extending along and supporting said lower leg portion;

connecting means for connecting a portion of said first support means to said base portion for movement relative thereto in opposite directions generally parallel to a line extending through said ankle joint and said hip joint;

second support means for extending along and supporting said upper leg portion, said first support means and said second support means being pivotally interconnected at a location positionable adjacent said knee joint; and means for translationally and pivotally driving said second support means to cause said first support means and said second support means to simultaneously flex said hip joint and said knee joint in a manner maintaining a predetermined correlation between the degree of flexure of said hip joint and said knee joint which is substantially independent of the length of said human leg, said means for translationally and pivotally driving said second support means including a drive member movably connected to said base portion, drive means selectively operable to translate said drive member in first and second opposite directions relative to said base portion, and linking means interconnected between said drive member and said second support means for causing simultaneous translation and pivoting of said second support means in response to translational movement of said drive member relative to said base portion, said second support means having a portion positionable adjacent a longitudinally intermediate section of said upper leg portion, said linking means functioning to simultaneously move said portion of said second support means in an arc generally centered about a line extending transversely through said hip joint and pivot said second support means in a manner causing a line extending through said portion of said second support means generally parallel to said upper leg portion to continuously extend generally transversely through said portion of said second support means said line extending transversely through said hip joint, said linking means including:

torque arm means pivotally carried by said drive member for movement therewith, first linking arm means pivotally connected at a first end portion thereof to said torque arm means and having a second end portion, pivot means secured to said portion of said second support means and pivotally connected to said second end portion of said first linking arm means, second linking arm means pivotally connected at a first end portion thereof to said torque arm means and having a second end portion pivotally connected to said pivot means, first cam means for pivoting said first linking arm means relative to said torque arm means in response to translational movement of said drive member relative to said base portion, and second cam means for pivoting said torque arm means in response to translational movement of said drive member relative to said base portion.

7. The apparatus of claim 4 wherein:

said linking means comprise a duality of linking arm means interconnected between said drive member and said second support means and positionable on opposite sides of said human leg, and said apparatus further comprises means for selectively adjusting the lateral spacing between said duality of linking arm means.

8. The apparatus of claim 2 wherein:

said drive means include an elongated lead screw member threadedly connected to said drive member, and motor means for selectively rotating said lead screw member in opposite directions.

9. The apparatus of claim 8 further comprising:

adjustable means for limiting the total length of linear travel of said drive member in said opposite directions.

10. The apparatus of claim 9 wherein:

said adjustable means include a spaced duality of limit switch means each operative to sense the movement of said drive member to a predetermined point and responsively reverse said motor means.

11. Apparatus for passively exercising a human leg having a hip joint, a knee joint, an ankle joint, an upper leg portion extending between said hip joint and said knee joint, and a lower leg portion extending between said knee joint and said ankle joint, said apparatus comprising:

first support means securable to said lower leg portion;

second support means securable to said upper leg portion, said second support means being pivotally connected to said first support means at a location positionable adjacent said knee joint;

means for translationally and pivotally driving said first support means and said second support means in a manner causing simultaneous flexure of said hip joint and said knee joint; and means for maintaining a predetermined correlation between the degree of flexure of said hip joint and said knee joint regardless of the overall length of said human leg, said means for maintaining a predetermined correlation including means, responsive to translational and pivotal movement of said first support means and said second support means, for causing said ankle joint to move in a substantially linear path along a line transversely intersecting a line extending transversely through said hip joint, and for causing said second support means to travel in a circular arc generally centered about said line extending transversely through said hip joint.

12. The apparatus of claim 11 wherein:

said apparatus further comprises a base portion, and said means for causing said ankle joint to move in a substantially linear path include means for connecting a portion of said first support means to said base portion for movement relative thereto generally parallel to said substantially linear path.

13. The apparatus of claim 12 wherein:

said base portion has a horizontally inclined guide member and said portion of said first support means is connected to said guide member for upwardly and downwardly inclined movement therealong.

14. The apparatus of claim 13 wherein:

said guide member is horizontally inclined approximately 20° and is positionable so that it slopes downwardly toward said hip joint when said human leg is operatively secured to said first support means and said second support means.

15. The apparatus of claim 13 wherein:

said predetermined correlation is expressed by the equation $KF=2(HF-I)$, wherein KF is the knee flexure angle, HF is the hip flexure angle, and I is the horizontal inclination angle of said guide member.

16. The apparatus of claim 15 wherein:

the horizontal inclination angle of said guide member is approximately 20°.

17. The apparatus of claim 11 wherein said means for translationally and pivotally driving said first support means and said second support means comprise:

a drive member movable in opposite directions generally parallel to said linear path, drive means for sequentially driving said drive member in said opposite directions, and linking means, interconnected between said drive member and said second support means, for causing simultaneous pivotal and translational motion of said second support means in response to driven movement of said drive member in said opposite directions.

18. Apparatus for passively exercising a human leg having a hip joint, a knee joint, an ankle joint, an upper leg portion extending between said hip joint and said knee joint, and a lower leg portion extending between said knee joint and said ankle joint, said apparatus comprising:

first support means securable to said lower leg portion;

second support means securable to said upper leg portion, said second support means being pivotally connected to said first support means at a location positionable adjacent said knee joint;

means for translationally and pivotally driving said first support means and said second support means in a manner causing simultaneous flexure of said hip joint and said knee joint; and means for maintaining a predetermined correlation between the degree of flexure of said hip joint and said knee joint regardless of the overall length of said human leg, said means for maintaining a predetermined correlation including means, responsive to translational and pivotal movement of said first support means and said second support means, for causing said ankle joint to move in a substantially linear path along a line transversely intersecting a line extending transversely through said hip joint, said means for translationally and pivotally driving said first support means and said second support means comprising:

a drive member movable in opposite directions generally parallel to said linear path, drive means for sequentially driving said drive member in said opposite directions, and linking means, interconnected between said drive member and said second support means, for causing simultaneous pivotal and translational motion of said second support means in response to driven movement of said drive member in said opposite directions, said linking means functioning in a manner causing said second support means to travel in a circular arc generally centered about a line extending transversely through said hip joint, said linking means including:

torque arm means pivotally carried by said drive member for movement therewith, first linking arm means pivotally connected at a first end portion thereof to said torque arm means and having a second end portion, pivot means secured to said second support means and pivotally connected to said second end portion of said first linking arm means, second linking arm means pivotally connected at a first end portion thereof to said torque arm means and having a second end portion pivotally connected to said pivot means, first cam means for pivoting said first linking arm means relative to said torque arm means in response to translational movement of said drive member, and second cam means for pivoting said torque arm means in response to translational movement of said drive member.

19. The apparatus of claim 12 further comprising:

foot and ankle support means, connected to said first support means for movement therewith, for supporting the foot and ankle of said human leg, and means for selectively adjusting said foot and ankle support means to control flexure of said ankle joint during flexure of said human leg by said apparatus.

20. The apparatus of claim 19 wherein:

said means for connecting a portion of said first support means to said base portion are pivotally connected to said portion of said first support means, said foot and ankle support means include a foot support member pivotally connected to said portion of said first support means, and said means for selectively adjusting said foot and ankle support means include means for adjustably locking said foot support member to a selected one of said portion of said first support means and said means for connecting a portion of said first support means to said base portion.

21. A passive motion exerciser for simultaneously flexing the hip and knee joints of a human leg having an ankle joint, an upper leg portion extending between said hip joint and said knee joint, and a lower leg portion extending between said knee joint and said ankle joint, said passive motion exerciser comprising:

an elongated leg support frame structure adapted to extend along and be connected to said human leg, said support frame structure having:

a first outer end portion positionable adjacent said ankle joint, a second outer end portion positionable adjacent a longitudinally intermediate section of said upper leg portion, and a pivotable, longitudinally intermediate section positionable adjacent said knee joint;

a guide member positionable generally parallel to an essentially straight line extending through said ankle joint and said hip joint;

a connecting member interconnected between said first outer end portion of said leg support frame structure and said guide member and being movable along said guide member in response to movement of said leg support frame structure;

a drive member supported for movement relative to said guide member;

a drive system operable to selectively drive said drive member in opposite directions relative to said guide member; and linking means, interconnected between said drive member and said second outer end portion of said leg support frame structure, and responsive to driven motion of said drive member, for moving said second outer end portion of said leg support frame structure in an arc generally centered about a line extending transversely through said hip joint, and for causing pivoting of said leg support frame structure about said longitudinally intermediate section thereof in a manner maintaining a predetermined, aligned relationship between said second outer end portion of said leg support frame structure and said line extending transversely through said hip joint and simultaneously causing said first outer end portion of said support frame structure, and thus said ankle joint, to travel in an essentially straight line which at all times passes through said hip joint.

22. The passive motion exerciser of claim 21 wherein:

said passive motion exerciser further comprises a base portion having a bottom surface adapted to rest upon a generally horizontal support surface, and said guide member is inclined relative to said bottom surface.

23. The passive motion exerciser of claim 22 wherein:

said guide member is inclined approximately 20° relative to said bottom surface.

24. The passive motion exerciser of claim 22 wherein:

said guide member has track means for movably supporting said drive member and said connecting member.

25. The passive motion exerciser of claim 21 wherein:

said first outer end portion of said leg support frame structure is pivotally connected to said connecting member, and said passive motion exerciser further comprises a foot support member pivotally connected to said first outer end portion of said leg support frame structure, and locking means for locking said foot support member to a selected one of said first outer end portion of said leg support frame structure and said connecting member.

26. The passive motion exerciser of claim 21 wherein said leg support frame structure comprises:

first and second pairs of elongated, telescopingly engaged support members adapted to be positioned on opposite sides of said lower leg portion;

third and fourth pairs of elongated, telescopingly engaged support members which are adapted to be positioned on opposite sides of said upper leg portion and are pivotally connected to said first and second pairs of support members, respectively;

means for selectively adjusting the overall lengths of said first, second, third and fourth pairs of support members;

first cradle means, interconnected between and depending from said first and second pairs of support members, for supporting said lower leg portion;

second cradle means, interconnected between and depending from said third and fourth pairs of support members, for supporting said upper leg portion; and means for selectively adjusting the depth of said first cradle means and said second cradle means.

27. The passive motion exerciser of claim 26 wherein:

said first and second pairs of support members are gimballed to said connecting member in a manner permitting pivotal motion of opposite side portions of said leg support frame structure toward and away from one another to compensate for thickness variations in a human leg supported in said leg support frame structure, and means, interconnected between said opposite side portions, for locking said opposite side portions in a desired relative positional relationship.

28. The passive motion exerciser of claim 21 wherein:

said linking means include first and second elongated arm means positioned on opposite sides of said guide member, said first and second arm means being connected at first end portions thereof to said second outer end portion of said leg support frame structure, and gimballed at second end portions thereof to said drive member in a manner permitting pivotal motion of said first and second arm members toward and away from one another to compensate for thickness variations in a human leg supported in said leg support frame structure, and means, interconnected between said first and second arm means, for locking said first and second arm means in a desired relative positional relationship.

29. The passive motion exerciser of claim 21 wherein said drive system includes:

an elongated lead screw member threadedly engaged with said drive member, and motor means selectively operable to rotate said lead screw in opposite directions.

30. The passive motion exerciser of claim 29 wherein:

said drive system further includes adjustable means for limiting the total length of travel of said drive member in said opposite directions.

31. The passive motion exerciser of claim 30 wherein:

said adjustable means include a spaced duality of movable limit switch means each operative to sense the movement of said drive member to a predetermined point and responsively reverse said motor means.

32. The passive motion exerciser of claim 31 wherein:

said passive motion exerciser further comprises a tab member secured to said drive member for movement therewith, and said duality of movable limit switch means are optical switches having light beams adapted to be broken by passage therethrough of said tab member.

33. The passive motion exerciser of claim 32 wherein:

said adjustable means further include a spaced duality of backup mechanical limit switches positionable outwardly of said optical switches for contact by said tab member, said mechanical limit switches each being operative to reverse said motor means if contacted by said tab member.

34. The passive motion exerciser of claim 21 wherein said linking means include:

first and second cam plate members positioned on opposite sides of said guide member, each of said first and second cam plate members having formed therethrough a first cam slot extending generally parallel to said guide member and a second cam slot having a curved configuration;

first and second torque arm members respectively positioned adjacent said first and second cam plate members;

first connecting means, received in said said first cam slots for movement therealong, for pivotally connecting first portions of said first and second torque members to said drive member for movement therewith;

said connecting means secured to second portions of said first and second torque arm members and received in said second cam slots for movement therealong;

first and second elongated arm members positioned on opposite sides of said guide member, said first and second arm members having linear end portions connected to said first connecting means for movement therewith, and outer end portions;

first and second pivot members pivotally connected to said outer end portions of said first and second arm members, respectively, and secured to said second outer end portion of said leg support frame structure;

third and fourth elongated arm members positioned on opposite sides of said guide member, said third and fourth arm members having outer end portions pivotally connected to said first and second pivot members, respectively, and inner end portions pivotally connected to third portions of said first and second torque arm members, respectively; and cam means for causing pivotal motion of said first and second arm members in response to motion of said drive member.

35. A passive motion exerciser for simultaneously flexing the hip and knee joints of a human leg having an ankle joint, an upper leg portion extending between said hip joint and said knee joint, and a lower leg portion extending between said knee joint and said ankle joint, said passive motion exerciser comprising:

an elongated leg support frame structure adapted to extend along and be connected to said human leg, said support frame structure having:

a first outer end portion positionable adjacent said ankle joint, a second outer end portion positionable adjacent a longitudinally intermediate section of said upper leg portion, and a pivotable, longitudinally intermediate section positionable adjacent said knee joint;

a guide member positionable generally parallel to a line extending through said ankle joint and said hip joint;

a connecting member interconnected between said first outer end portion of said leg support frame structure and said guide member and being movable along said guide member in response to movement of said leg support frame structure;

a drive member supported for movement relative to said guide member;

a drive system operable to selectively drive said drive member in opposite directions relative to said guide member; and linking means, interconnected between said drive member and said second outer end portion of said leg support frame structure, and responsive to driven motion of said drive member, for moving said second outer end portion of said leg support frame structure in an arc generally centered about a line extending transversely through said hip joint, and for causing pivoting of said leg support frame structure about said longitudinally intermediate section thereof in a manner maintaining a predetermined, aligned relationship between said second outer end portion of said leg support frame structure and said line extending transversely through said hip joint, said linking means including:

first and second cam plate members positioned on opposite sides of said guide member, each of said first and second cam plate members having formed therethrough a first cam slot extending generally parallel to said guide member and a second cam slot having a curved configuration, first and second torque arm members respectively positioned adjacent said first and second cam plate members, first connecting means, received in said said first cam slots for movement therealong, for pivotally connecting first portions of said first and second torque arm members to said drive member for movement therewith, second connecting means secured to second portions of said first and second torque arm members and received in said second cam slots for movement therealong, first and second elongated arm members positioned on opposite sides of said guide member, said first and second arm members having inner end portions connected to said first connecting means for movement therewith, and outer end portions;

first and second pivot members pivotally connected to said outer end portions of said first and second arm members, respectively, and secured to said second outer end portion of said leg support frame structure;

third and fourth elongated arm members positioned on opposite sides of said guide member, said third and fourth arm members having outer end portions pivotally connected to said first and second pivot members, respectively, and inner end portions pivotally connected to third portions of said first and second torque arm members, respectively; and cam means for causing pivotal motion of said first and second arm members in response to motion of said drive member, and said cam means including cam members carried by said first and second arm members, and roller means engageable by said cam members.

36. The passive motion exerciser of claim 34 wherein:

said inner end portions of said first and second arm members are gimballed to said first connecting means, said inner end portions of said third and fourth arm members are gimballed to said third portions of said first and second torque arm members.

37. The passive motion exerciser of claim 21 further comprising:

alignment means for aligning said exerciser with said hip joint.

38. The passive motion exerciser of claim 37 wherein:

said alignment means comprise an elongated alignment member removable connectable at one end portion thereof to said second outer end portion of said leg support frame structure, and having an opposite end portion alignable with said hip joint.

39. The passive motion exerciser of claim 21 further comprising:

a base portion having a bottom surface adapted to rest upon a generally horizontal support surface, said bottom surface having an end edge portion which generally faces said second outer end portion of said leg support frame structure and projects downwardly from the balance of said bottom surface.

40. Passive motion exercising apparatus comprising:

support means for supporting a human leg, said support means being cyclically drivable to cause cyclic flexing and unflexing of the hip and knee joints of said human leg supported thereby;

means, connected to a first portion of said support means, for cyclically driving said support means; and means for maintaining a predetermined, essentially linear correlation between the hip joint flexure angle and the knee joint flexure angle of said human leg regardless of the length thereof, said means for maintaining including means, connected to a second portion of said support means, for causing the ankle joint of said human leg to move in opposite directions generally along an essentially straight line extending at all times through the hip and ankle joints of said human leg during said cyclic flexing and unflexing of the hip and knee joints of said human leg, and means for causing said first portion of said support means to travel in a circular arc generally centered about a line passing transversely through said hip joint during said cyclic flexing and unflexing of the hip and knee joints of said human leg.

41. The apparatus of claim 40 wherein:

said line extending through the hip and ankle joints of said human leg is horizontally inclined.

42. The apparatus of claim 41 wherein:

the inclination angle of said line extending through the hip and ankle joints of said human leg is approximately 20°.

43. The apparatus of claim 40 wherein:

said support means include an articulated leg support frame structure having opposite end portions, and opposite side portions positionable on opposite sides of said human leg, said means for cyclically driving said support means are connected to one of said end portions thereof, said means for causing the ankle joint to move in opposite directions are connected to the other of said end portions, and said means for cyclically driving are operative to move said one of said end portions in an arc generally centered about a line extending transversely through the hip joint of said human leg.

* * * * *